US011832067B2

(12) United States Patent
Klinke et al.

(10) Patent No.: US 11,832,067 B2
(45) Date of Patent: Nov. 28, 2023

(54) OPEN-LOOP MULTICHANNEL AUDIO IMPULSE RESPONSE MEASUREMENT AND CAPTURE PATH EVALUATION

(71) Applicant: Intel Corporation, Santa Clara, CA (US)

(72) Inventors: Piotr Klinke, Szczecin (PL); Jan Banas, Gdansk (PL); Damian Koszewski, Gdansk (PL); Przemyslaw Maziewski, Gdansk (PL); Pawel Pach, Gdansk (PL); Pawel Trella, Gdansk (PL)

(73) Assignee: Intel Corportation, Santa Clara, CA (US)

( * ) Notice: Subject to any disclaimer, the term of this patent is extended or adjusted under 35 U.S.C. 154(b) by 581 days.

(21) Appl. No.: 16/886,225

(22) Filed: May 28, 2020

(65) Prior Publication Data

US 2020/0359146 A1 Nov. 12, 2020

(51) Int. Cl.
*H04R 29/00* (2006.01)
*H04R 3/04* (2006.01)

(52) U.S. Cl.
CPC ..... *H04R 29/005* (2013.01); *H04R 3/04* (2013.01); *H04R 29/001* (2013.01); *H04R 29/008* (2013.01)

(58) Field of Classification Search
CPC ..... H04R 29/005; H04R 3/04; H04R 29/001; H04R 29/008
USPC ..... 381/58
See application file for complete search history.

(56) References Cited

U.S. PATENT DOCUMENTS

2017/0006399 A1* 1/2017 Maziewski ..... H04R 29/004

OTHER PUBLICATIONS

Gamper Hannes,"Clock Drift Estimation and Compensation for Asynchronous Impulse Response Measurements", 2017 Hands-free Speech Communications and Microphone Arrays (HSCMA), IEEE, 2017. 5 pages.

* cited by examiner

*Primary Examiner* — Paul Kim
(74) *Attorney, Agent, or Firm* — HANLEY, FLIGHT & ZIMMERMAN, LLC

(57) ABSTRACT

Techniques are provided for audio capture path evaluation of microphones incorporated into a device under test (DUT). A methodology implementing the techniques according to an embodiment includes estimating impulse responses (IRs) of the DUT microphones based on a comparison of a test audio signal received through the DUT microphones, at a selected measurement angle, to the test audio signal received through a reference microphone. The method also includes calculating group delays for the DUT microphones based on phase responses of the estimated IRs and calculating an average of the group delays. The method further includes calculating a distance, projected onto the measurement angle, between the DUT microphones and a geometric center of the DUT microphones. The distance is calculated as a product of the speed of sound and a difference between the average delay and the group delays for the DUT microphones. The process is repeated for additional measurement angles.

20 Claims, 15 Drawing Sheets

Directional Sensitivity
Measurement Setup
700

OPEN-LOOP MULTICHANNEL AUDIO IMPULSE RESPONSE MEASUREMENT AND CAPTURE PATH EVALUATION

BACKGROUND

Modern speech-enabled devices, such as laptops, smart phones, and smart speakers, often support multi-channel audio inputs. These devices may include anywhere from two to eight microphones (or more) which are integrated into the device. It is frequently useful to measure the characteristics of these microphones for testing, quality assurance, and/or validation of functionality for various applications. The devices, however, are generally "closed boxes," which do not allow for direct access to the microphones. Removing or desoldering the microphones for measurement is impractical, and in any event would alter the characteristics of the microphones. Thus, it can be difficult or impossible to measure the microphone characteristics using standard closed-loop measurement techniques (i.e., where a measurement system both stimulates the microphone and analyzes the captured audio through a physical connection to the microphone). Instead, these microphones must typically be measured as an integral part of the device, and the resulting measurements are distorted by factors such as the physical properties of the inlet channels of the device, the quality of the A/D converters, and any signal processing that is performed in the software stack of the device.

Figure 1:
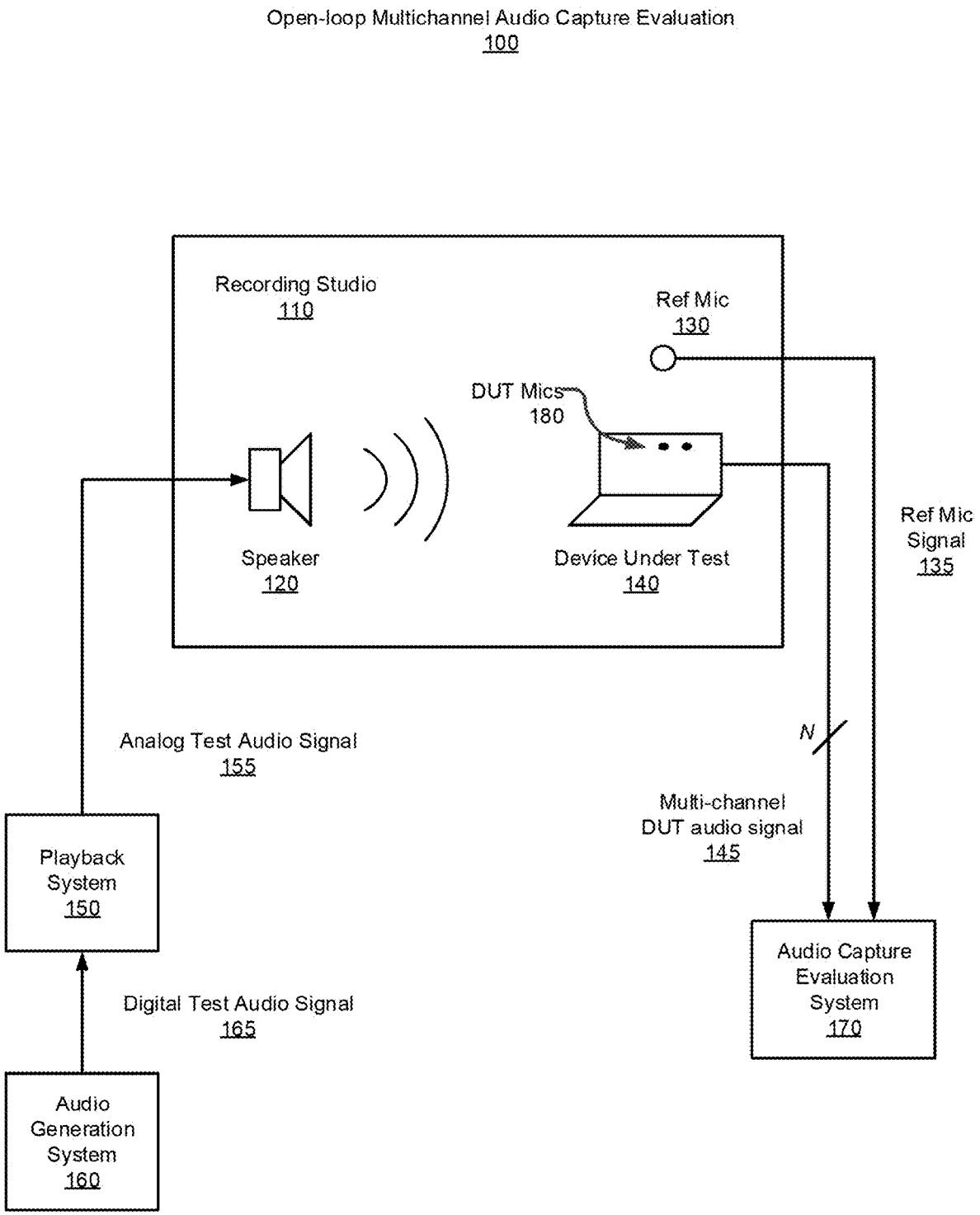
FIG. 1 is a high-level diagram of a system for open-loop multichannel audio capture evaluation, configured in accordance with an embodiment of the present disclosure.

Although the following Detailed Description will proceed with reference being made to illustrative embodiments, many alternatives, modifications, and variations thereof will be apparent in light of this disclosure.

DETAILED DESCRIPTION

Techniques are provided for characterization of microphones that are integrated into a platform, such as a speech-enable device. The techniques are particularly useful for open-loop multichannel audio impulse response (IR) measurement and capture path evaluation for microphones integrated into mobile computing systems, but can be used in any number of processor-based systems having a microphone. The device containing the microphone(s) is referred to herein as a device under test (DUT). Microphone characterization may be used for testing, manufacturing quality assurance, and/or validation of functionality for various applications such as beamforming. As previously noted, it is difficult to measure the characteristics of microphones in situations where direct physical access to the microphones is not possible or practical. Instead, these microphones are typically measured as an integral part of the device, and such measurements can be distorted by factors such as the physical properties of the inlet channels of the device housing, the quality of the A/D converters and other circuitry in the audio capture path, and signal processing that is performed in the software stack of the device, to name a few examples.

The disclosed open-loop impulse response measurement techniques allow for separate systems to provide playback and evaluation of the audio captured by the DUT, without need for synchronization between the playback and evaluation systems, or direct physical access to the microphones of the DUT. In more detail, and according to an embodiment, the playback device is configured to generate an audio test signal for playback (e.g., broadcast) to the microphones of the DUT. The audio test signal is also broadcast to a reference microphone provided as part of the evaluation system. The DUT microphones and the reference microphone are configured to capture the provided audio test signal. The audio capture evaluation system is configured to analyze the captured audio signals and evaluate the DUT microphones, in a manner that is independent of the effects of integration of those microphones in the DUT. The evaluation includes estimation of the impulse responses of the microphones, measurement of directional sensitivity of the microphones, and validation of the geometric layout of the microphones on the DUT. The geometric layout of the microphones refers to the location of the microphones within the device and relative to one another. Validation of the geometric layout of the microphone array is particularly useful to evaluate the functionality of beamforming applications which depend on time delay (or equivalently phase shift) between the microphones, which in turn depends on the relative spacing or geometric layout of the microphones.

The disclosed techniques can be implemented, for example, in a computing system or a software product executable or otherwise controllable by such systems, although other embodiments will be apparent. In one such embodiment, a methodology implementing the techniques includes estimating impulse responses of the DUT microphones based on a comparison of a test audio signal received through the DUT microphones, at a given angle of incidence (also referred to herein as a measurement angle), to the test audio signal received through a reference microphone, as will be described in greater detail below. The method also includes calculating group delays for the DUT microphones based on phase responses of the estimated impulse responses. The group delays provide a measure of the time delay of the sinusoidal frequency components of a signal through each of the microphones. The method further includes calculating a distance between each DUT microphone and a geometric center of the array of DUT microphones. In some such embodiments, the distance is calculated as a product of the speed of sound and a difference between the group delays for each of the DUT microphones and an average of the group delays. The process may be repeated for additional angles of incidence and the distances for each angle may be combined, for each microphone, to generate cartesian coordinates for the microphones. These generated coordinates may then be compared to expected values (e.g., provided by the manufacturing specifications) to validate the DUT. In some embodiments, directional sensitivity of the microphones may be determined over the range of measurement angles, as will be described in greater detail below.

As will be appreciated, the techniques described herein may provide an improved process for characterization of microphones that are integrated in a speech-enabled device or platform (DUT), compared to existing techniques that suffer from measurement distortion induced by DUT related factors. The disclosed techniques can be implemented on a broad range of platforms including workstations, laptops, tablets, and smartphones. These techniques may further be implemented in hardware or software or a combination thereof.

System Architecture

FIG. 1 is a high-level diagram of a system for open-loop multichannel audio capture evaluation 100, configured in accordance with an embodiment of the present disclosure. The system 100 is shown to include an audio generation system 160, a playback system 150, a speaker 120, a DUT 140 (with integrated microphones 180), a reference microphone 130, and an audio capture evaluation system 170. In some embodiments, the speaker 120, reference microphone 130, and DUT 140, may be located in a recording studio 110, or other suitable environment that is relatively free of noise, and configured to reduce reverberation and other undesired audio effects. The operation of these components will be explained in greater detail below, but at a high-level, the audio generation system 160 is configured to generate a digital test audio signal 165, to be provided to the playback system 150 which generates an analog test audio signal 155 for broadcast through speaker 120. The reference microphone 130 captures the broadcast test audio signal as the reference microphone signal 135 for provision to the audio capture evaluation system 170. The DUT microphones 180 also captures the broadcast test audio signal as multi-channel DUT audio signal 145 (N channels) for provision to the audio capture evaluation system 170. The reference microphone 130 is typically located as close to the DUT microphones 180 as is practical, to minimize differences in propagation of the broadcast test audio signal between the microphones. The audio capture evaluation system 170 is configured to analyze the captured audio signals 135 and 145 and evaluate the audio capture path of the DUT microphones 180. The evaluation includes estimation of the IRs of the microphones 180, measurement of directional sensitivity of the microphones 180, and validation of the geometric layout of the microphones 180 on the DUT 140. The estimation of the IRs of the microphones 180 accounts for any effects arising from the integration of the microphones in the DUT 140.

Figure 2:
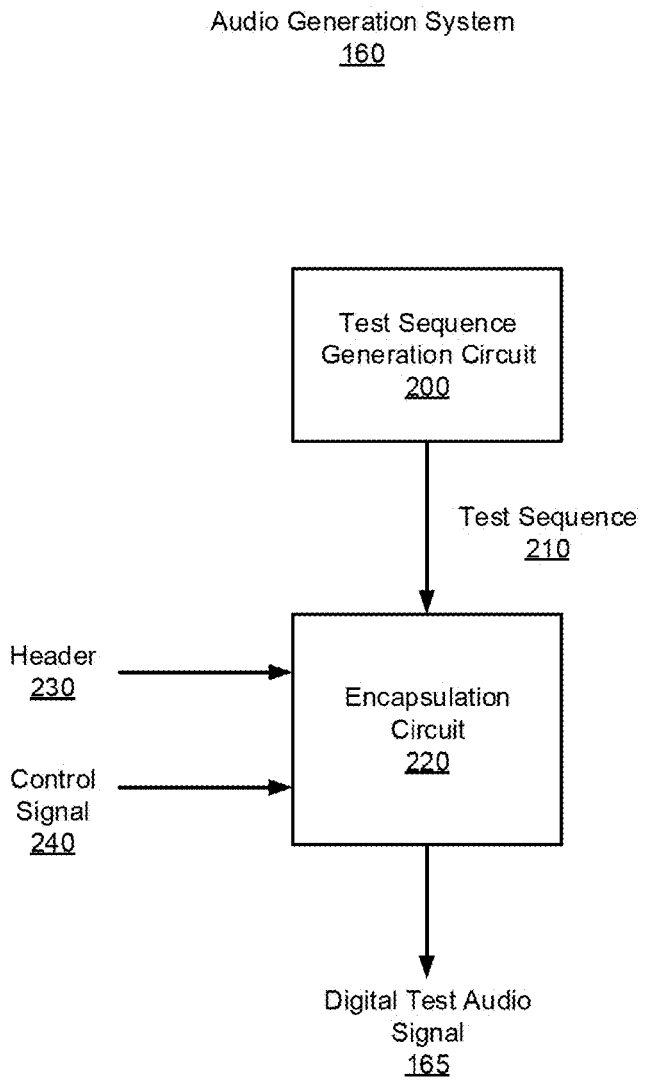
FIG. 2 is a block diagram of an audio generation system, configured in accordance with an embodiment of the present disclosure.

FIG. 2 is a block diagram of an audio generation system 160, configured in accordance with an embodiment of the present disclosure. The audio generation system 160 is shown to include a test sequence generation circuit 200 and an encapsulation circuit 220. The test sequence generation circuit 200 is configured to generate a digital test sequence 210. In some embodiments, the digital test sequence may be a chirp signal or a maximum length sequence. The digital test sequence may be on the order of 30 seconds in length.

The encapsulation circuit 220 is configured to encapsulate the digital test sequence 210 with additional components, including a synchronization header 230 and a control signal 240 to generate the digital test audio signal 165. In some embodiments, the synchronization header 230 may be an exponential chirp signal, on the order of one second in length, or other known short-time signal that is relatively easy to detect using cross correlation methods. In some embodiments, the control signal 240 may be a tone of known frequency, for example a 32 second 1 kHz tone, that serves as a clock compensation control signal, as will be explained in greater detail below in connection with the audio capture techniques. The resulting digital test audio signal 165 is provided to the playback system 150, which is configured to convert that signal to an analog test audio signal 155 for broadcast through speaker 120.

Figure 3:
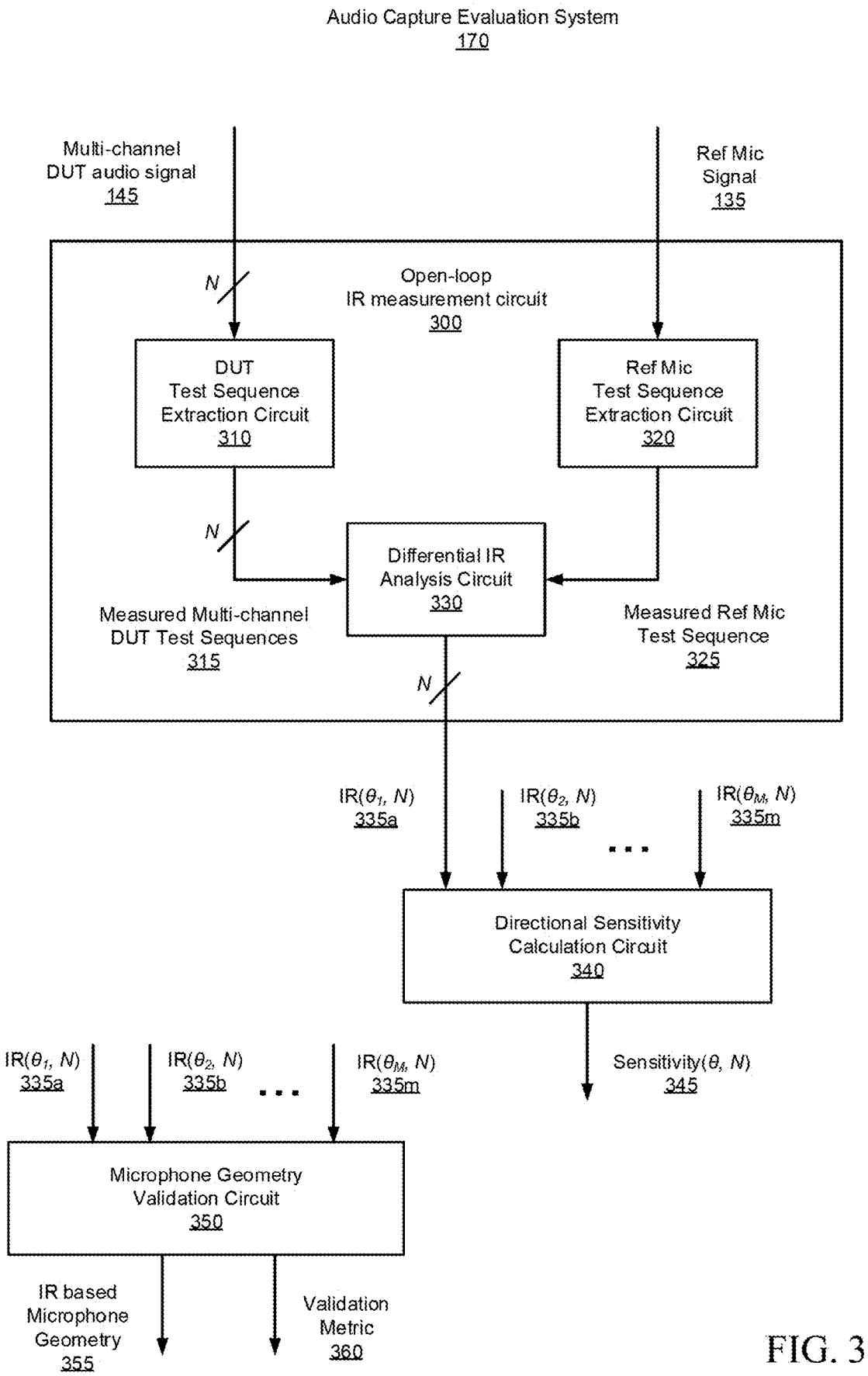
FIG. 3 is a top-level block diagram of an audio capture evaluation system, configured in accordance with an embodiment of the present disclosure.

FIG. 3 is a top-level block diagram of an audio capture evaluation system 170, configured in accordance with an embodiment of the present disclosure. The audio capture evaluation system 170 is shown to include an open-loop IR measurement circuit 300, a directional sensitivity calculation circuit 340, and a microphone geometry validation circuit 350. The open-loop IR measurement circuit 300 is further shown to include a DUT test sequence extraction circuit 310, a reference microphone test sequence extraction circuit 320, and a differential IR analysis circuit 330. The open-loop IR measurement circuit 300 is configured to estimate the IRs of each of the N DUT microphones 180 based on a comparison (e.g., differential IR analysis) of the test audio signal received through the DUT microphones 180 (e.g., Multi-channel DUT audio signals 145) to the test audio signal received through the reference microphone 130 (e.g., reference microphone signal 135), as will be described in greater detail below.

Figure 4:
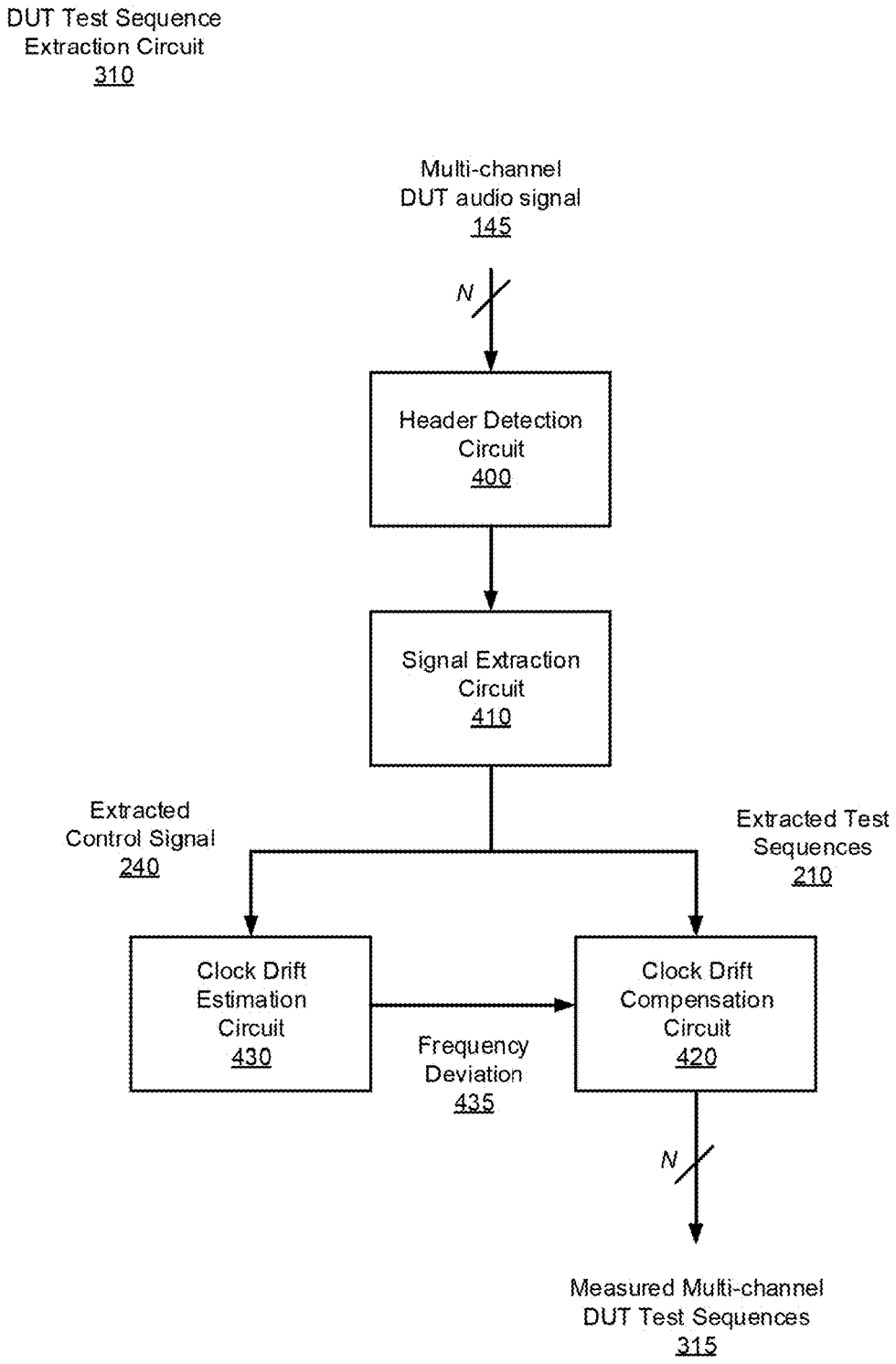
FIG. 4 is a block diagram of a test sequence extraction circuit for the device under test (DUT) microphones, configured in accordance with an embodiment of the present disclosure.

FIG. 4 is a block diagram of a test sequence extraction circuit 310 for the DUT microphones 180, configured in accordance with an embodiment of the present disclosure. The DUT test sequence extraction circuit 310 operates on each of the N channels of the DUT audio signals (e.g., one channel for each DUT microphone 180). The DUT test sequence extraction circuit 310 is shown to include a header detection circuit 400, a signal extraction circuit 410, a clock drift estimation circuit 430, and a clock drift compensation circuit 420.

The header detection circuit 400 is configured to detect the synchronization header 230 in each DUT audio signal 145. In some embodiments, a cross correlation synchronization technique is used to find the known header (e.g., the exponential chirp signal) in the audio signal 145.

The signal extraction circuit 410 is configured to extract the control signal 240 and the test sequence 210 from the audio signal based on their known locations in the audio signal 145 relative to the detected header.

The clock drift estimation circuit 430 is configured to calculate the frequency of the tone in the extracted control signal 240 and measure the deviation of that frequency 435 from the known correct value. Because embodiments of the disclosed technique are configured as an open-loop system, the clocks on the playback system 150, the DUT 140, and the audio capture evaluation system are generally not synchronized. The clock drift compensation circuit 420 is configured to compensate for the measured frequency deviation 435 to correct the extracted test sequence 210 for clock drift that may occur. This is particularly important with some DUTs (such as inexpensive IoT devices) that use lower quality clocking circuits. Clock drift correction improves the IR estimation process for the DUT microphones 180. The resulting N clock drift compensated test sequences are provided to the differential IR analysis circuit 330, as measured multi-channel DUT test sequences 315.

Figure 5:
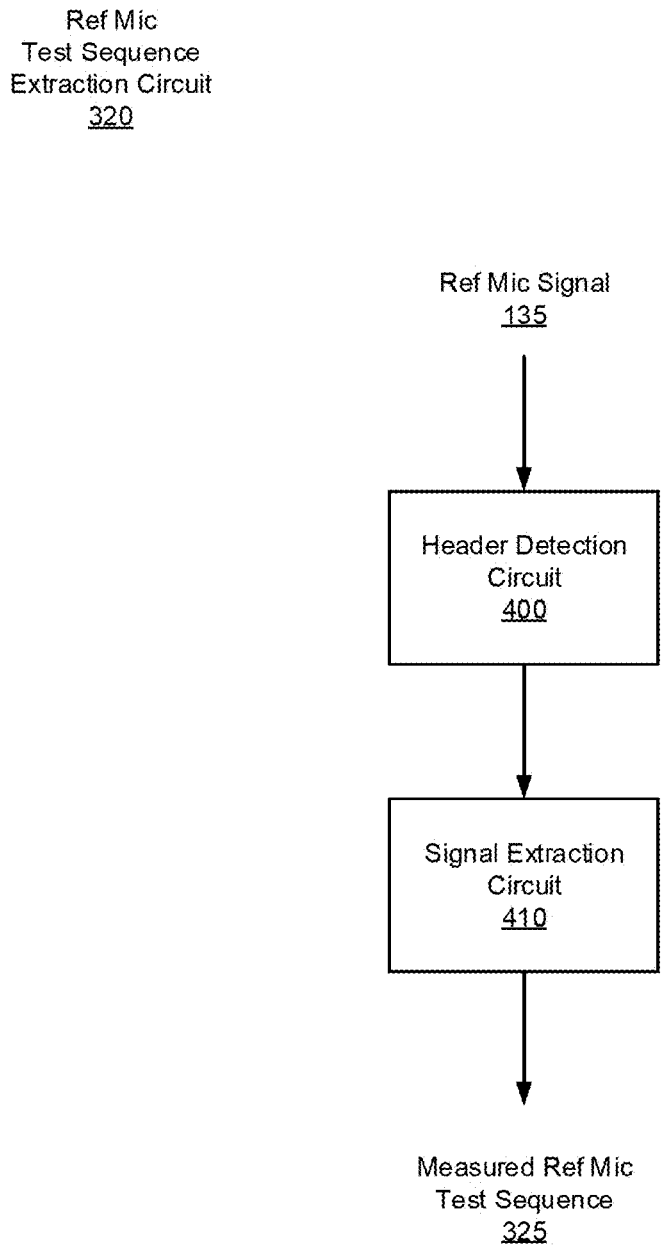
FIG. 5 is a block diagram of a test sequence extraction circuit for the reference microphone, configured in accordance with an embodiment of the present disclosure.

FIG. 5 is a block diagram of a test sequence extraction circuit 320 for the reference microphone 130, configured in accordance with an embodiment of the present disclosure. The reference microphone test sequence extraction circuit 320 is shown to include the header detection circuit 400 and the signal extraction circuit 410, which function in the same manner as described above for the DUT test sequence extraction circuit 310. Clock drift compensation is not required for the reference microphone since the reference microphone signal bypasses the DUT and is therefore unaffected by any possible clock drift problems associated with the DUT. The resulting clock drift compensated test sequence is provided to the differential IR analysis circuit 330, as measured reference microphone test sequence 325.

Figure 6:
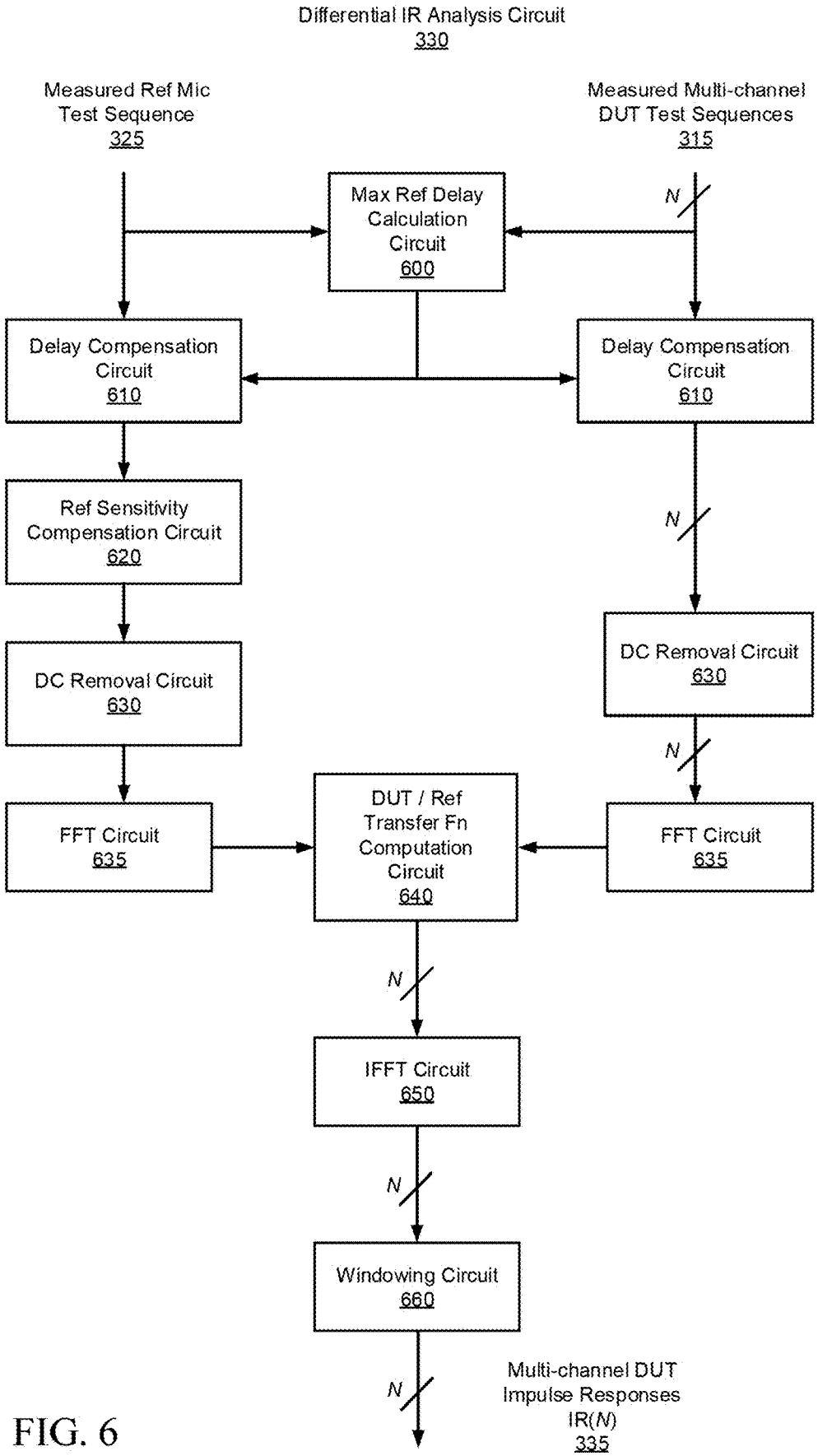
FIG. 6 is a block diagram of a differential impulse response (IR) analysis circuit, configured in accordance with an embodiment of the present disclosure.

FIG. 6 is a block diagram of a differential IR analysis circuit 330, configured in accordance with an embodiment of the present disclosure. The differential IR analysis circuit 330 is shown to include a maximum reference delay calculation circuit 600, a delay compensation circuit 610, a reference sensitivity compensation circuit 620, a DC removal circuit 630, a Fast Fourier Transform (FFT) circuit 635, a DUT/Reference transfer function computations circuit 640, an inverse FFT circuit 650, and a windowing circuit 660.

The maximum reference delay calculation circuit 600 is configured to determine the maximum of the delays between the measured reference microphone test sequence 325 and each of the measured multi-channel DUT tests sequences 315. In some embodiments, this is accomplished using cross correlation techniques.

The delay compensation circuit 610 is configured to remove the determined maximum delay from the measured reference microphone test sequence 325 and the measured multi-channel DUT tests sequences 315, so that this delay is uniformly compensated for across all channels while preserving the inter-channel delay or phase response relationships between each channel.

The reference sensitivity compensation circuit 620 is configured to compensate the reference microphone signal for the known sensitivity characteristics of the reference microphone.

The DC removal circuit 630 is configured to remove any DC bias in the measured reference microphone test sequence and each of the measured multi-channel DUT tests sequences, and the FFT circuit 635 is configured to transform the reference microphone test sequence and the N measured multi-channel DUT tests sequences into the frequency domain. In some embodiments, techniques other than an FFT may be used for the frequency domain conversion.

The DUT/Reference transfer function computations circuit 640 is configured to compute the transfer functions between the reference channel and each of the N DUT channels by spectral division of the frequency domain N measured multi-channel DUT tests sequences by the frequency domain reference microphone test sequence.

The inverse FFT circuit 650 is configured to transform the transfer functions back to the time domain to generate the multi-channel DUT IRs 335. In some embodiments, techniques other than an inverse FFT may be used for the time domain conversion.

In some embodiments, the windowing circuit 660 is configured to trim the N generated IRs 335 to a desired length, for example, using a Tukey windowing function, or other suitable technique.

Figure 7:
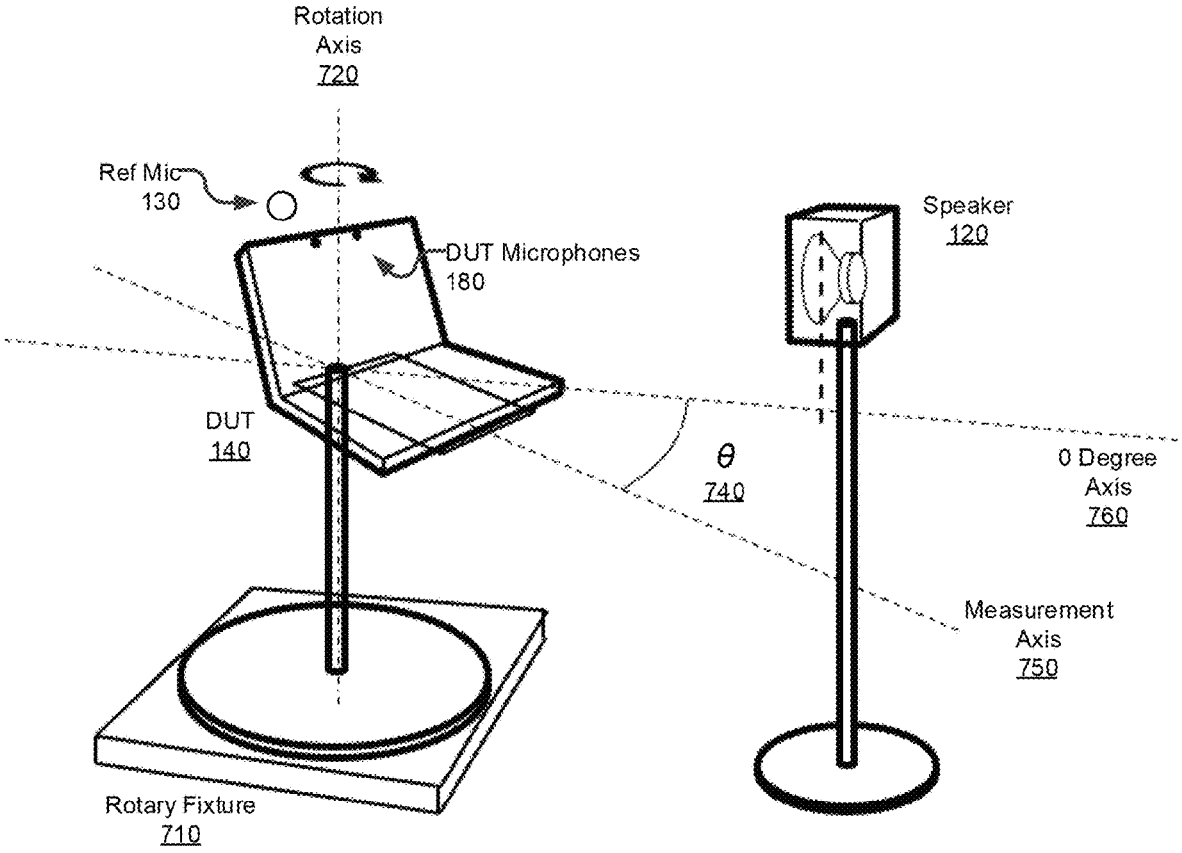
FIG. 7 illustrates a directional sensitivity measurement setup, in accordance with an embodiment of the present disclosure.

FIG. 7 illustrates a directional sensitivity measurement setup 700, in accordance with an embodiment of the present disclosure. As shown in this setup, the DUT 140 is mounted on a rotary fixture 710 that is configured to rotate the DUT about the rotation axis 720, for example, over a 360 degree angular sweep of azimuth, or any portion thereof. The speaker 120 is shown to be positioned at the zero degree axis 760 for convenience. For the directional sensitivity measurement process, the DUT 140 is rotated to a desired number of different measurement axes 750, at azimuth angles θ 740 relative to the zero degree axis 760. In some embodiments, θ may be incremented by five degrees for each measurement. The reference microphone 130 is also shown to be located relatively close to the DUT microphones 180, but does not need to be rotated, as the reference microphone 130 is generally configured as an omnidirectional microphone. The techniques described above, for IR estimation of the N DUT microphones, may be performed for each measurement angle θ 740 (e.g., for each measurement axis 750) to generate an IR (θ, k) for k=1,N 335*a*, 335*b*, . . . 335*m*.

Figure 8:
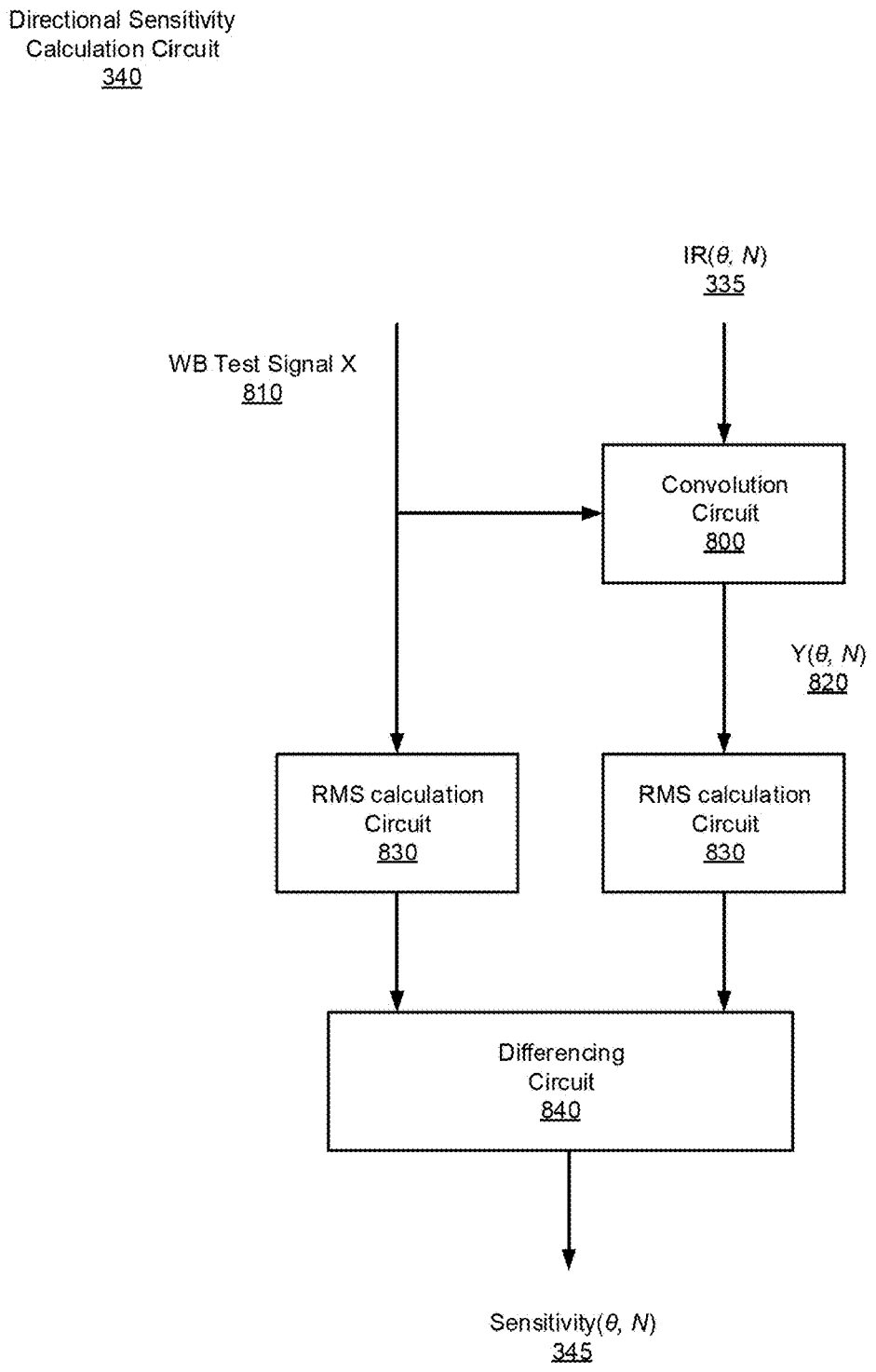
FIG. 8 is a block diagram of a directional sensitivity calculation circuit, configured in accordance with an embodiment of the present disclosure.

FIG. 8 is a block diagram of a directional sensitivity calculation circuit 340, configured in accordance with an embodiment of the present disclosure. The directional sensitivity calculation circuit 340 is shown to include a convolution circuit 800, an RMS calculation circuit 830, and a differencing circuit 840.

The convolution circuit 800 is configured to convolve the each DUT impulse response IR(θ, N) (for each channel and each angle) with a test signal X 820 of known level, to generate a filtered signal Y 820:

$$Y(\theta, N)=X \otimes IR\ (\theta, N)$$

In some embodiments, the test signal X 820 may be a wideband pink noise signal. In some other embodiments, the test signal X 820 may be a speech-shaped noise signal, an artificial speech signal, or a real speech signal, which may provide improved estimation of directional sensitivity to speech. The RMS calculation circuit 830 is configured to calculate the root mean square (RMS) levels of the signal before filtration 810 and of the signal after filtration 820.

The differencing circuit 840 is configured to calculate the sensitivity 345 as the difference between the RMS values:

$$\text{sensitivity}(\theta, N)=\text{RMS}(Y(\theta, N))-\text{RMS}(X)$$

In some embodiments, the process may also be performed for different elevation angles to produce a 3-dimensional sensitivity pattern.

Figure 9:
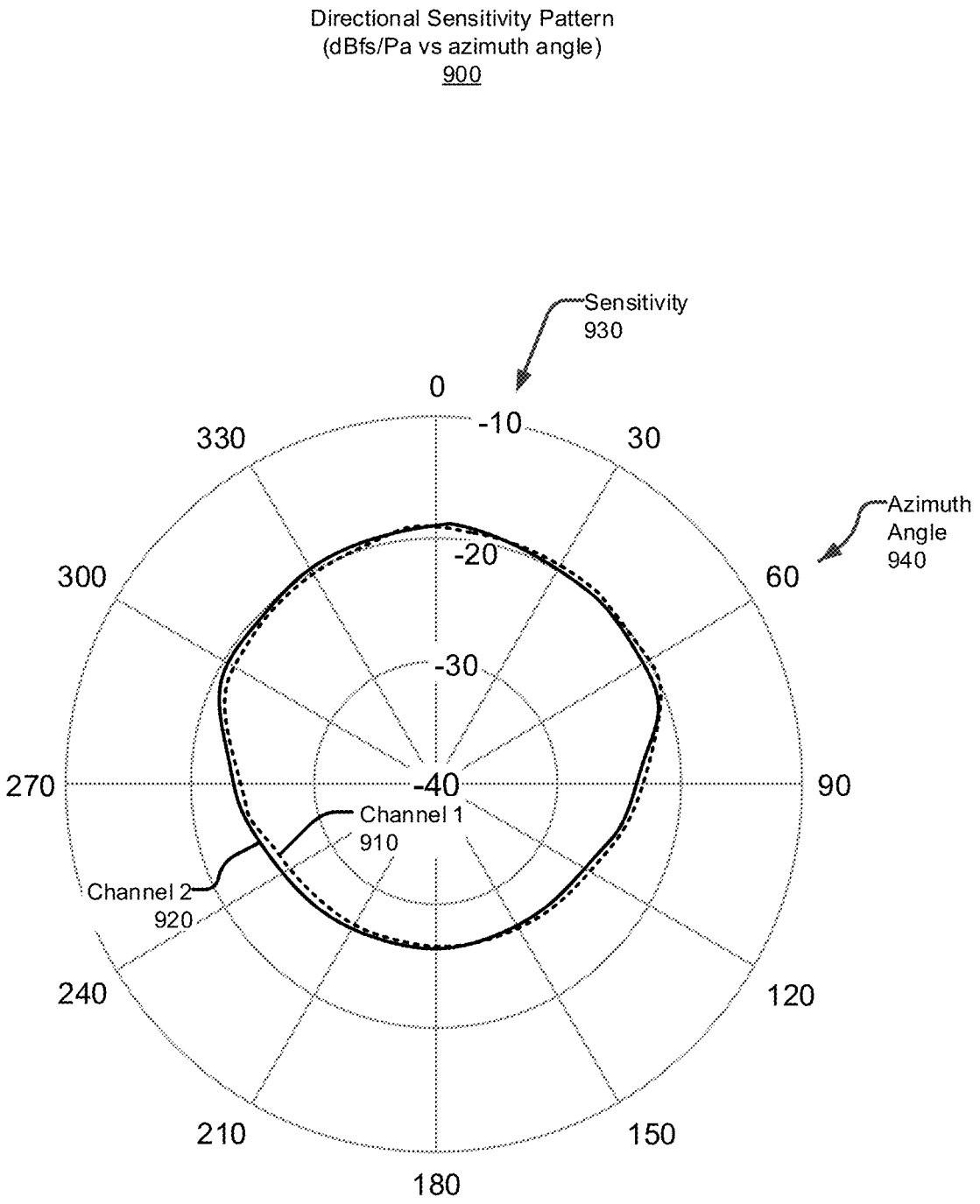
FIG. 9 illustrates a directional sensitivity pattern, in accordance with an embodiment of the present disclosure.

FIG. 9 illustrates a directional sensitivity pattern 900, in accordance with an embodiment of the present disclosure. The directional sensitivity is shown as a polar plot for channel 1 910 (associated with a first DUT microphone 180*a*) and a polar plot for channel 2 920 (associated with a second DUT microphone 180*b*). The polar plots are generated from sensitivity(θ, N) 345, as provided by directional sensitivity calculation circuit 340. These polar plots display microphone sensitivity 930 versus azimuth angle 940 for each channel. In this example sensitivity is expressed as decibels relative to full scale (dBfs) versus in-air sound pressure in a Pascals (Pa), and ranges from −10 to −40 dBfs/Pa over the azimuth range of zero to 360 degrees.

This plot can be used to evaluate acoustic design features of the DUT platform. For example, inter-channel sensitivity coherence (e.g., similarity of the plots for different channels) suggests symmetrical microphone placement and correct microphone inlet alignment. A visible cardioid polar pattern (e.g., approximately 7 dB attenuation at 180 degrees) may indicate a potential problem with supporting a 360 degree OEM/client specification.

Figure 10:
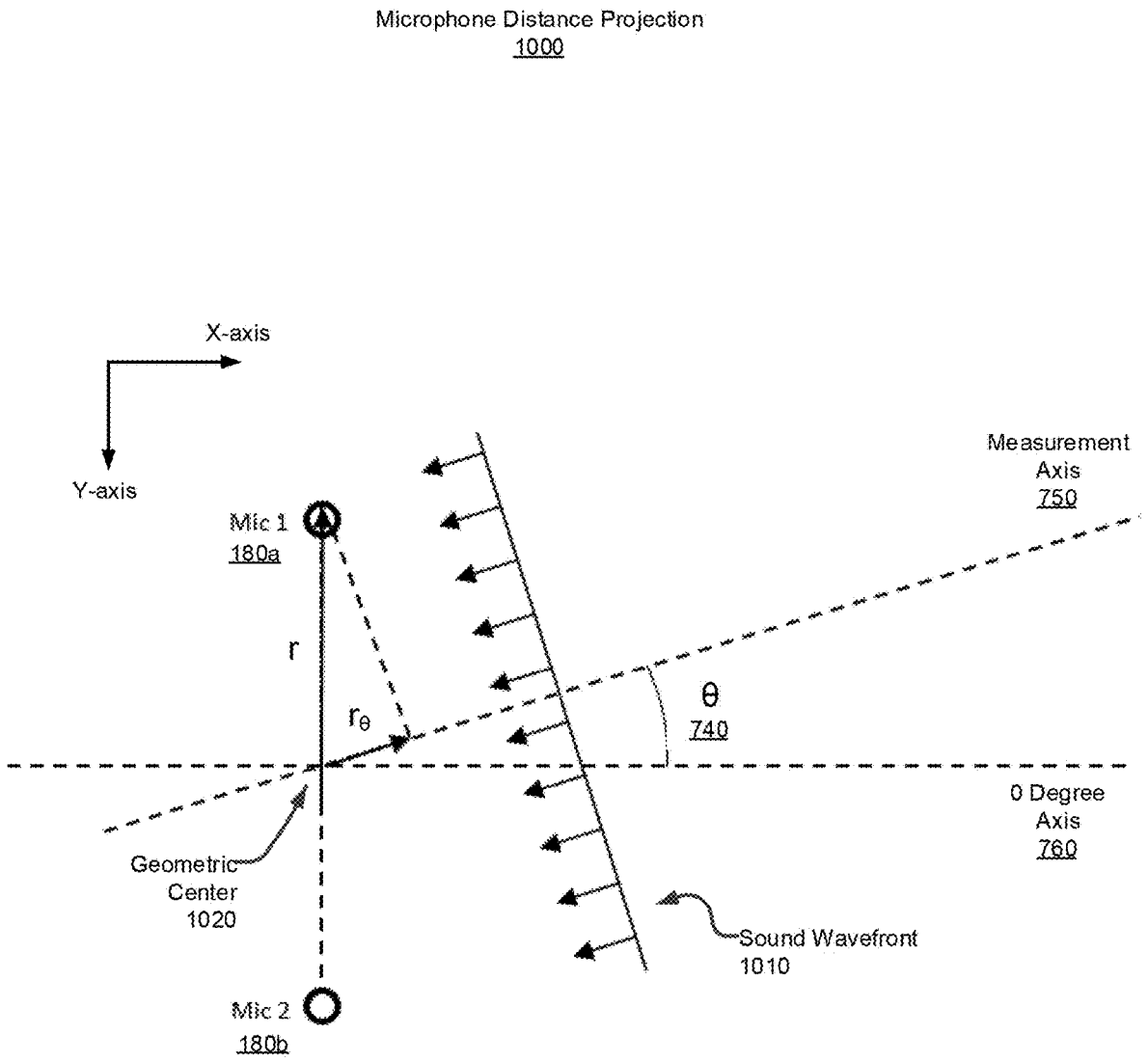
FIG. 10 illustrates a microphone distance projection, in accordance with an embodiment of the present disclosure.
Figure 12:
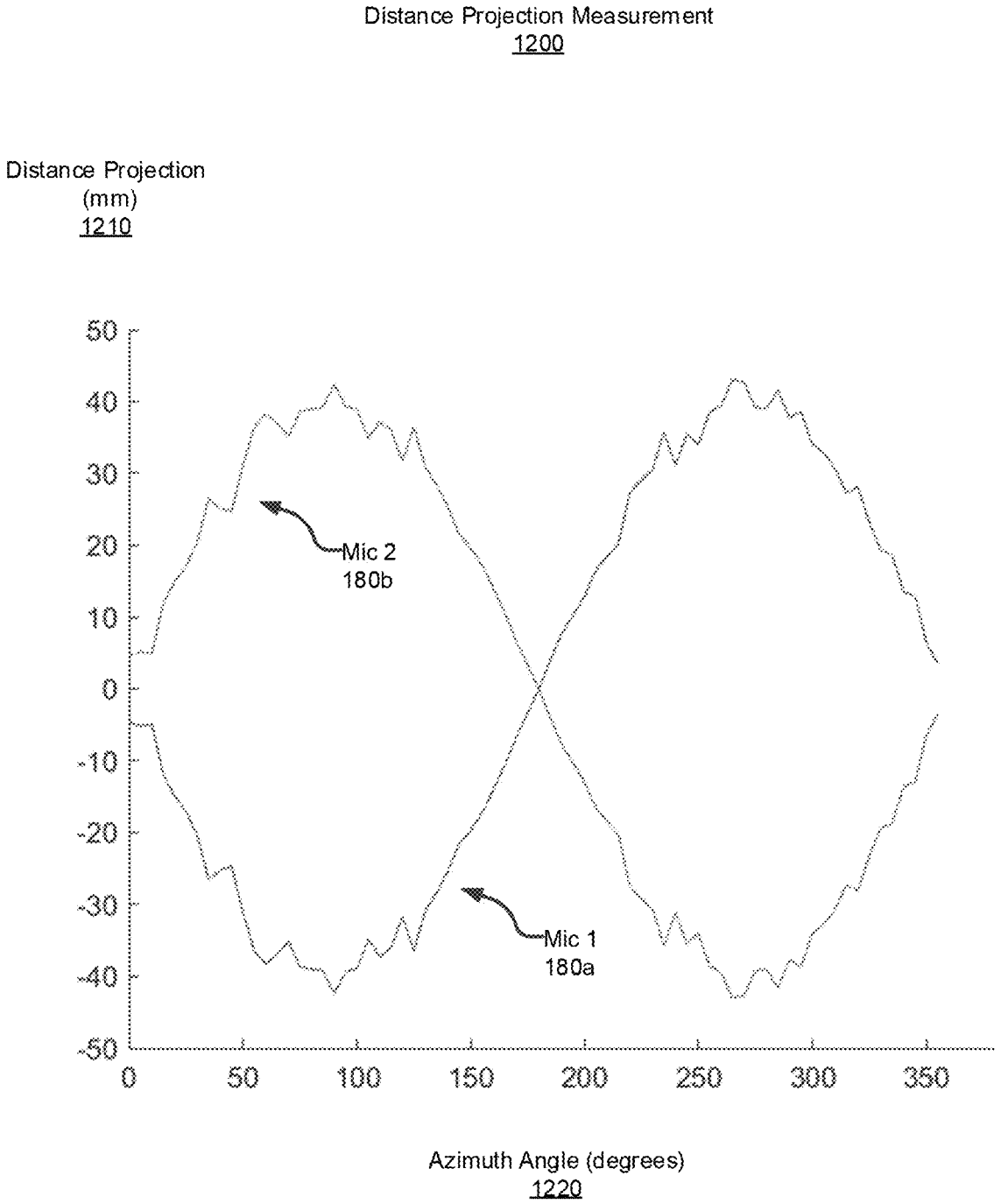
FIG. 12 illustrates microphone distance projection measurements, in accordance with an embodiment of the present disclosure.

FIG. 10 illustrates a microphone distance projection 1000, in accordance with an embodiment of the present disclosure. Microphone distance projection 1000 is employed as part of the microphone geometry validation process described below. The microphone distance projection 1000 is a projection, for each DUT microphone 180, along the measurement axis 750, of the distance of that DUT microphone from the geometric center 1020 of the microphone array. FIG. 10 illustrates a sound wavefront 1010, of the broadcast audio test signal, arriving along measurement axis 750, at angle θ 740 relative to the zero degree axis 760. For simplicity, only two DUT microphones are shown. The wavefront 1010 arrives at DUT microphones 180*a* and 180*b* at different times due to the varying travel distances resulting from the geometric layout of the microphones. This in turn results in measurable phase differences between the microphone channels. The distance r of microphone 180*a* from the geometric center 1020 is projected onto the measurement axis 750 and illustrated as $r_\theta$. Projections can be calculated for each DUT microphone and for each measurement axis, to determine the microphone geometry (e.g., the location of the microphones within the device, and relative to each other), as described below. An example plot of distance projections versus measurement angle for two microphones is shown in FIG. 12.

Figure 11:
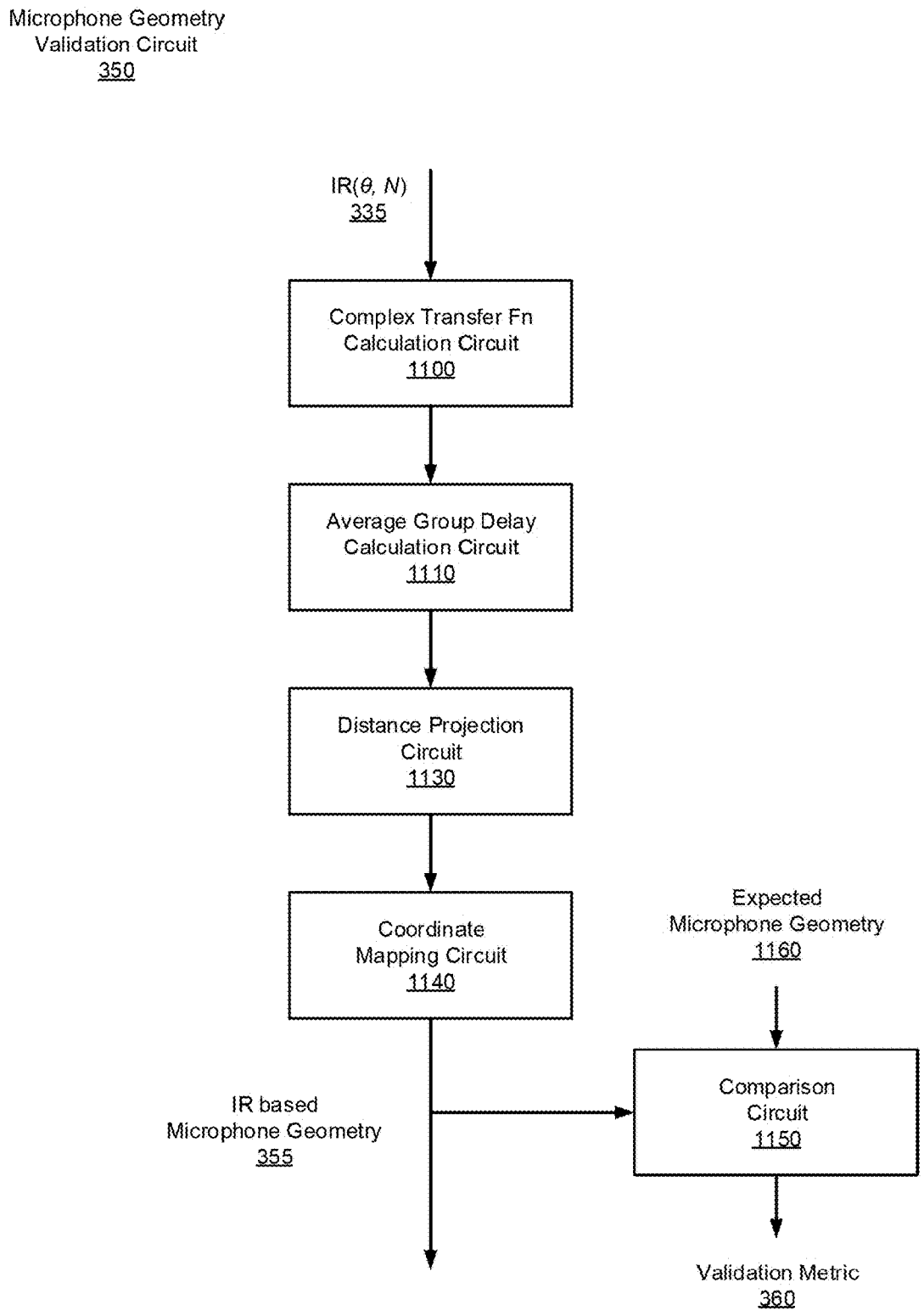
FIG. 11 is a block diagram of a microphone geometry validation circuit, configured in accordance with an embodiment of the present disclosure.

FIG. 11 is a block diagram of a microphone geometry validation circuit 350, configured in accordance with an embodiment of the present disclosure. The microphone geometry validation circuit 350 is shown to include a complex transfer function calculation circuit 1100, an average group delay calculation circuit 1110, a distance projection circuit 1130, a coordinate mapping circuit 1140, and a comparison circuit 1150.

The complex transfer function calculation circuit 1100 is configured to calculate a complex transfer function H (θ, N), and associated phase response φ(θ, N), for the estimated IRs for each channel and measurement angle by converting the IR into the frequency domain:

$$H(\theta, N)=\mathrm{FFT}\{\mathrm{IR}(\theta, N)\}$$

$$\varphi(\theta, N)=\arg\{H(\theta, N)\}$$

The average group delay calculation circuit 1110 is configured to calculate group delays τ(θ, N), for the estimated IRs for each channel and measurement angle, based on the phase response. In some embodiments, the group delay is the average, over frequency, of the derivative of the phase response with respect to frequency, as expressed below (where the bar symbol indicates the average or mean of the expression below the bar):

$$\tau(\theta, N) = -\overline{\frac{d\varphi(\theta, N)}{d\omega}}$$

The average group delay calculation circuit 1110 is also configured to calculate an average of the group delays across all channels ($\overline{\tau(\theta,N)}$).

The distance projection circuit 1130 is configured to transform the delays into distances $|\vec{e}_\theta(\theta, N)|$ between the microphone and the geometric center of the microphone array, wherein the distances are projected onto the measurement axis. The projected distances are illustrated and described below in connection with FIG. 12. In some embodiments, the projected distances may be calculated by subtracting the average group delay across all channels from the group delays for each channel and multiplying by the speed of sound. This may be expressed as follows, where c is the speed of sound:

$$|\vec{r}_\theta(\theta, N)|=(\tau(\theta, N)-\overline{\tau(\theta,N)})\cdot c$$

The coordinate mapping circuit 1140 is configured to map the projected distances into Cartesian coordinates (e.g., coordinates in an x,y plane). In some embodiments, the projected distances are grouped into orthogonal (e.g., perpendicular) pairs and each pair is combined through vector addition to generate an estimate of the x,y location of the microphone. These estimates can be clustered, as illustrated and described below in connection with FIG. 13, and an average of the cluster locations may be used as an estimate of the location of the microphone, as IR based microphone geometry 355.

The comparison circuit 1150 is configured to compare the IR based microphone geometry 355 with the expected microphone geometry or ground truth 1160. The expected geometry may be provided, for example, by manufacturer specifications. In some embodiments, a validation metric 360 may be calculated based on the comparison. For example, the validation metric may be based on an error distribution of the IR based microphone geometry 355 relative to ground truth 1160, and may be calculated as a mean absolute error:

$$MeanAbsoluteError = \frac{\sum_{i=1}^{n} |e_i|}{n}$$

where e is the difference between the IR based microphone geometry 355 and ground truth 1160.

The validation metric may be useful to quantify the beamforming capabilities of the DUT platform. For example, a larger error may generally be associated with poorer beamforming performance and the ability of beamforming to provide denoising capability. The validation metric may also be used to track manufacturing quality, and/or design faults.

FIG. 12 illustrates microphone distance projection measurements 1200, in accordance with an embodiment of the present disclosure. Distance projections $r_\theta$ (in mm) 1210 are plotted for DUT microphone 1 180*a* and DUT microphone 2 180*b*, versus measurement or azimuth angle 1220. The projections correspond to the geometry illustrated in FIG. 10. As can be seen, the projections are close to zero mm for angles zero degrees and 180 degrees, and the projections reach their maximum values for angles 90 degrees and 270 degrees. This is as expected since the microphones are located along a vertical axis oriented from 90 to 270 degrees.

Figure 13:
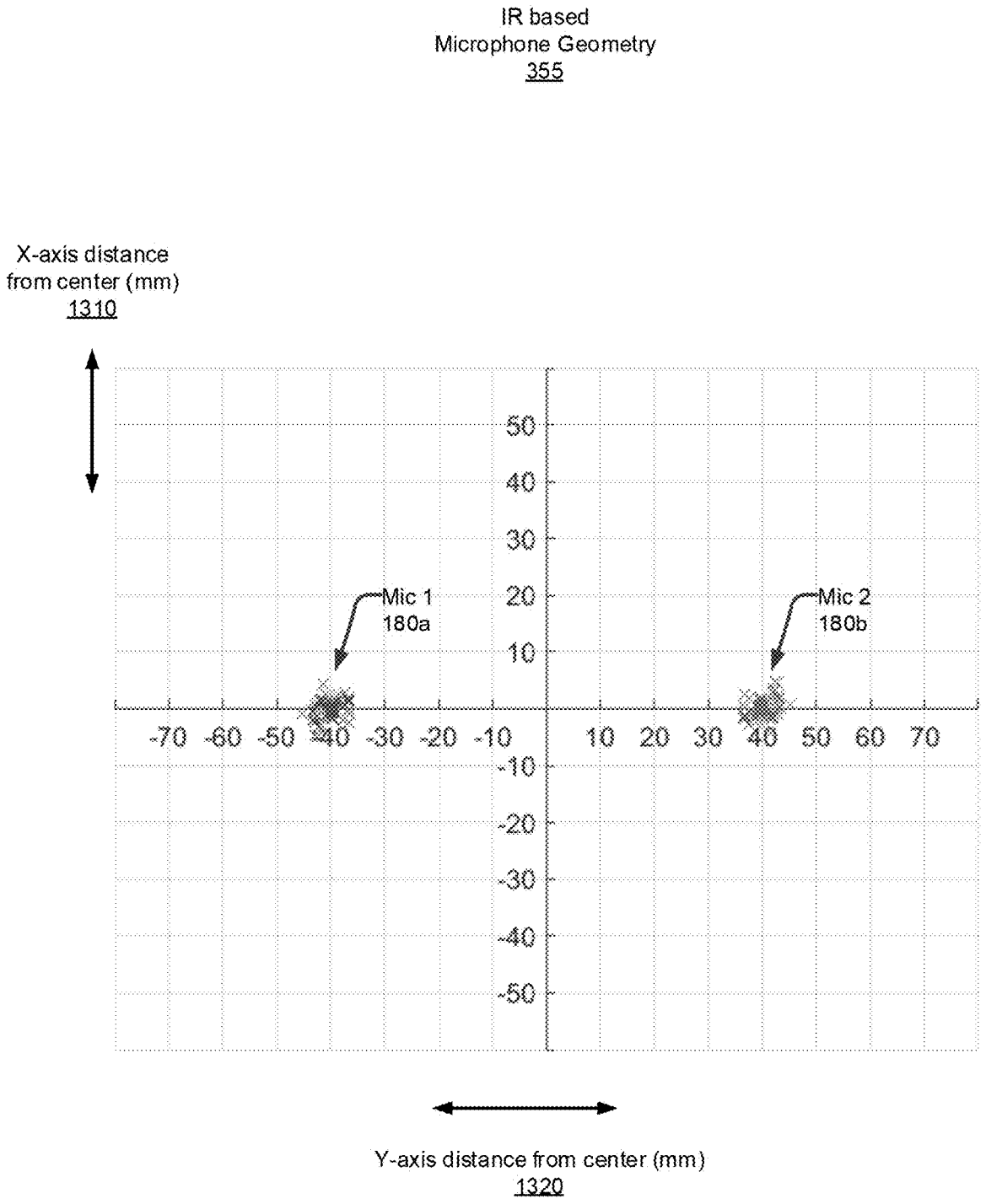
FIG. 13 illustrates IR based microphone geometry, in accordance with an embodiment of the present disclosure.

FIG. 13 illustrates IR based microphone geometry 355, in accordance with an embodiment of the present disclosure. The distance projection measurements from FIG. 12 are mapped into an x,y cartesian coordinate plane which illustrates the microphone layout geometry, for microphone 1 180*a* and microphone 2 180*b*, as described above. A cross mark is indicated for each combination of orthogonal projection measurements for each microphone. As can be seen microphone 1 clusters at (0, −40) and microphone 2 clusters at (0, +40), as expected.

Methodology

Figure 14:
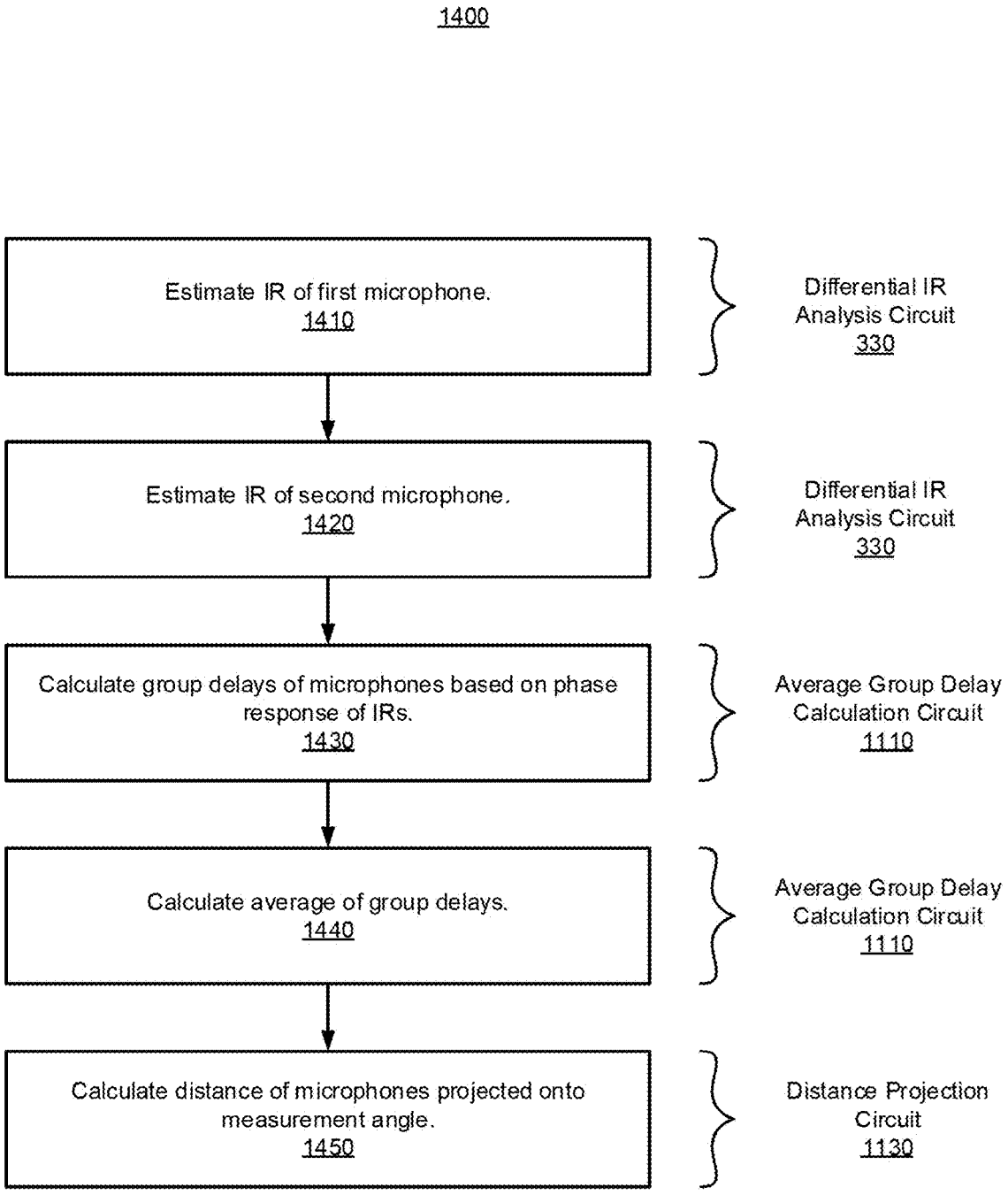
FIG. 14 is a flowchart illustrating a methodology for audio capture evaluation, in accordance with an embodiment of the present disclosure.

FIG. 14 is a flowchart illustrating a methodology 1400 for audio capture evaluation, in accordance with an embodiment of the present disclosure. As can be seen, the example method includes a number of phases and sub-processes, the sequence of which may vary from one embodiment to another. However, when considered in the aggregate, these phases and sub-processes form a process for audio capture evaluation, in accordance with certain of the embodiments disclosed herein. These embodiments can be implemented, for example, using the system architecture illustrated in FIGS. 1-8, 11, and 15, as described herein. However other system architectures can be used in other embodiments, as will be apparent in light of this disclosure. To this end, the correlation of the various functions shown in FIG. 14 to the specific components illustrated in the other figures is not intended to imply any structural and/or use limitations. Rather, other embodiments may include, for example, varying degrees of integration wherein multiple functionalities are effectively performed by one system. For example, in an alternative embodiment a single module having decoupled sub-modules can be used to perform all of the functions of method 1400. Thus, other embodiments may have fewer or more modules and/or sub-modules depending on the granularity of implementation. In still other embodiments, the methodology depicted can be implemented as a computer program product including one or more non-transitory machine-readable mediums that when executed by one or more processors cause the methodology to be carried out. Numerous variations and alternative configurations will be apparent in light of this disclosure.

As illustrated in FIG. 14, in an embodiment, method 1400 for audio capture evaluation commences at operation 1410, by estimating a first IR of a first microphone based on a comparison of a test audio signal received through the first microphone to the test audio signal received through a reference microphone, as previously described. The test audio signal is received through the first microphone at a first measurement angle. The measurement angle may be relative to an axis from the DUT to a loudspeaker configured to generate the test audio signal.

Next, at operation 1420, a second IR of a second microphone is estimated based on a comparison of the test audio signal received through the second microphone to the test audio signal received through the reference microphone, as previously described. The test audio signal is received through the second microphone at the first measurement angle.

At operation 1430, a group delay is calculated for the first microphone based on a phase response of the first estimated IR, and a group delay is calculated for the second microphone based on a phase response of the second estimated IR. In some embodiments, the group delay may be calculated as an average over frequency of a derivative of the phase response of the IR with respect to frequency.

At operation 1440, an average delay is calculated as an average of the group delay for the first microphone and the group delay for the second microphone.

At operation 1450, a distance, projected onto the measurement angle, is calculated between the first microphone and a geometric center of the first and second microphones, the distance is calculated as the product of the speed of sound and the difference between the average delay and the group delay for the first microphone. In some embodiments, a distance may be similarly calculated for the second microphone.

Of course, in some embodiments, additional operations may be performed, as previously described in connection with the system. For example, the process may be repeated for multiple additional measurement angles, for example covering 360 degrees at five-degree increments. In some embodiments, the process may be performed for more than two microphones, for example four, eight, or more microphones of an array of microphones of the DUT. The projected distances for each measurement angle may be combined, for each microphone, to generate cartesian coordinates for the microphones, which may then be compared to expected values (e.g., according to the manufacturing specifications) to validate the DUT.

In some embodiments, a directional sensitivity may be calculated for each microphone by applying the estimated IR (for each measurement angle) to a wideband pink noise test signal to generate a filtered test signal. The sensitivity may be calculated as a difference between a root mean square level of the test signal and a root mean square level of the filtered test signal, for each measurement angle.

Example System

Figure 15:
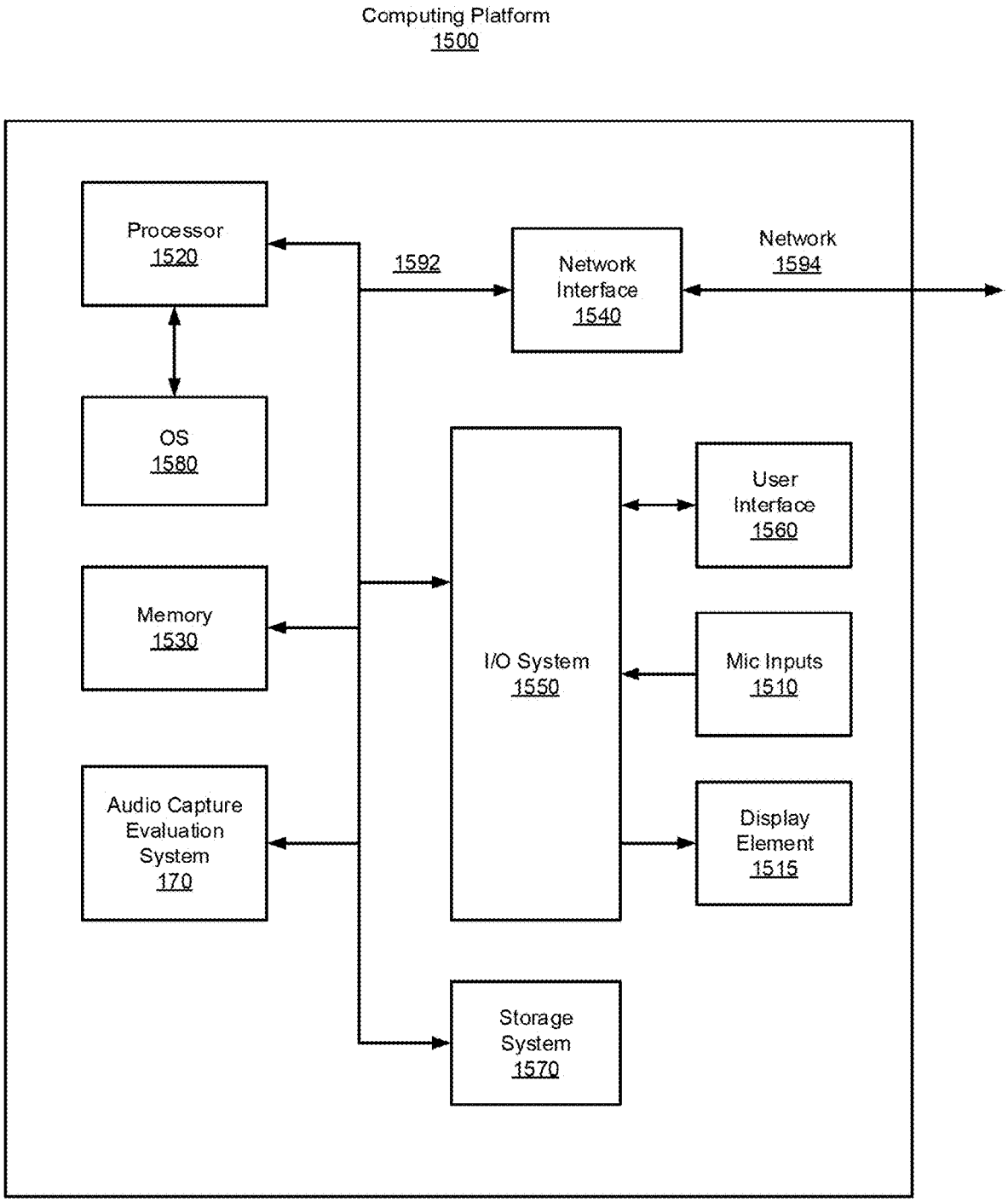
FIG. 15 is a block diagram schematically illustrating a computing platform configured to perform audio capture evaluation, in accordance with an embodiment of the present disclosure.

FIG. 15 is a block diagram schematically illustrating an example computing platform 1500 configured to perform audio capture evaluation, in accordance with an embodiment of the present disclosure. In some embodiments, platform 1500 may be hosted on, or otherwise incorporated into a personal computer, workstation, server system, laptop computer, ultra-laptop computer, tablet, touchpad, portable computer, handheld computer, palmtop computer, personal digital assistant (PDA), cellular telephone, combination cellular telephone and PDA, smart device (for example, smartphone, smart-speaker, or smart-tablet), mobile internet device (MID), messaging device, data communication device, embedded system, and so forth. Any combination of different devices may be used in certain embodiments.

In some embodiments, platform 1500 may comprise any combination of a processor 1520, a memory 1530, an audio capture evaluation system 170, a network interface 1540, an input/output (I/O) system 1550, a user interface 1560, microphone inputs 1510, a display element 1515, and a storage system 1570. As can be further seen, a bus and/or interconnect 1592 is also provided to allow for communication between the various components listed above and/or other components not shown. Platform 1500 can be coupled to a network 1594 through network interface 1540 to allow for communications with other computing devices, platforms, devices to be controlled, or other resources. Other componentry and functionality not reflected in the block diagram of FIG. 15 will be apparent in light of this disclosure, and it will be appreciated that other embodiments are not limited to any particular hardware configuration.

Processor 1520 can be any suitable processor, and may include one or more coprocessors or controllers, such as an audio processor, a graphics processing unit, or hardware accelerator, to assist in control and processing operations associated with platform 1500. In some embodiments, the processor 1520 may be implemented as any number of processor cores. The processor (or processor cores) may be any type of processor, such as, for example, a microprocessor, an embedded processor, a digital signal processor (DSP), a graphics processor (GPU), a tensor processing unit (TPU), a network processor, a field programmable gate array or other device configured to execute code. The processors may be multithreaded cores in that they may include more than one hardware thread context (or "logical processor") per core. Processor 1520 may be implemented as a complex instruction set computer (CISC) or a reduced instruction set computer (RISC) processor. In some embodiments, processor 1520 may be configured as an x86 instruction set compatible processor.

Memory 1530 can be implemented using any suitable type of digital storage including, for example, flash memory and/or random-access memory (RAM). In some embodiments, the memory 1530 may include various layers of memory hierarchy and/or memory caches as are known to those of skill in the art. Memory 1530 may be implemented as a volatile memory device such as, but not limited to, a RAM, dynamic RAM (DRAM), or static RAM (SRAM) device. Storage system 1570 may be implemented as a non-volatile storage device such as, but not limited to, one or more of a hard disk drive (HDD), a solid-state drive (SSD), a universal serial bus (USB) drive, an optical disk drive, tape drive, an internal storage device, an attached storage device, flash memory, battery backed-up synchronous DRAM (SDRAM), and/or a network accessible storage device. In some embodiments, storage 1570 may comprise technology to increase the storage performance enhanced protection for valuable digital media when multiple hard drives are included.

Processor 1520 may be configured to execute an Operating System (OS) 1580 which may comprise any suitable operating system, such as Google Android (Google Inc., Mountain View, Calif.), Microsoft Windows (Microsoft Corp., Redmond, Wash.), Apple OS X (Apple Inc., Cupertino, Calif.), Linux, or a real-time operating system (RTOS). As will be appreciated in light of this disclosure, the techniques provided herein can be implemented without regard to the particular operating system provided in conjunction with platform 1500, and therefore may also be implemented using any suitable existing or subsequently developed platform.

Network interface circuit 1540 can be any appropriate network chip or chipset which allows for wired and/or wireless connection between other components of platform 1500 and/or network 1594, thereby enabling platform 1500 to communicate with other local and/or remote computing systems, servers, cloud-based servers, and/or other resources. Wired communication may conform to existing (or yet to be developed) standards, such as, for example, Ethernet. Wireless communication may conform to existing (or yet to be developed) standards, such as, for example, cellular communications including LTE (Long Term Evolution) and 5G, Wireless Fidelity (Wi-Fi), Bluetooth, and/or Near Field Communication (NFC). Exemplary wireless networks include, but are not limited to, wireless local area networks, wireless personal area networks, wireless metropolitan area networks, cellular networks, and satellite networks.

I/O system 1550 may be configured to interface between various I/O devices and other components of platform 1500. I/O devices may include, but not be limited to, user interface 1560, microphone inputs 1510 (e.g., to receive signals from the DUT microphones and the reference microphone), and display element 1515. In some embodiments, the display element 1515 may be employed to display results of audio capture evaluation. User interface 1560 may include devices (not shown) such as a touchpad, keyboard, and mouse, etc. I/O system 1550 may include a graphics subsystem configured to perform processing of images for rendering on the display element. Graphics subsystem may be a graphics processing unit or a visual processing unit (VPU), for example. An analog or digital interface may be used to communicatively couple graphics subsystem and the display element. For example, the interface may be any of a high definition multimedia interface (HDMI), DisplayPort, wireless HDMI, and/or any other suitable interface using wireless high definition compliant techniques. In some embodiments, the graphics subsystem could be integrated into processor 1520 or any chipset of platform 1500.

It will be appreciated that in some embodiments, the various components of platform 1500 may be combined or integrated in a system-on-a-chip (SoC) architecture. In some embodiments, the components may be hardware components, firmware components, software components or any suitable combination of hardware, firmware or software.

Audio capture evaluation system 170 is configured to evaluate the audio capture path of the microphones of the DUT (including IR estimation, directional sensitivity, and microphone geometry validation), as described previously. Audio capture evaluation system 170 may include any or all of the circuits/components illustrated in FIGS. 1-8 and 11, as described above. These components can be implemented or otherwise used in conjunction with a variety of suitable software and/or hardware that is coupled to or that otherwise forms a part of platform 1500. These components can additionally or alternatively be implemented or otherwise used in conjunction with user I/O devices that are capable of providing information to, and receiving information and commands from, a user.

In some embodiments, these circuits may be installed local to platform 1500, as shown in the example embodiment of FIG. 15. Alternatively, platform 1500 can be implemented in a client-server arrangement wherein at least some functionality associated with these circuits is provided to platform 1500 using an applet, such as a JavaScript applet, or other downloadable module or set of sub-modules. Such remotely accessible modules or sub-modules can be provisioned in real-time, in response to a request from a client computing system for access to a given server having resources that are of interest to the user of the client computing system. In such embodiments, the server can be local to network 1594 or remotely coupled to network 1594 by one or more other networks and/or communication channels. In some cases, access to resources on a given network or computing system may require credentials such as usernames, passwords, and/or compliance with any other suitable security mechanism.

In various embodiments, platform 1500 may be implemented as a wireless system, a wired system, or a combination of both. When implemented as a wireless system, platform 1500 may include components and interfaces suitable for communicating over a wireless shared media, such as one or more antennae, transmitters, receivers, transceivers, amplifiers, filters, control logic, and so forth. An example of wireless shared media may include portions of a wireless spectrum, such as the radio frequency spectrum and so forth. When implemented as a wired system, platform 1500 may include components and interfaces suitable for communicating over wired communications media, such as input/output adapters, physical connectors to connect the input/output adaptor with a corresponding wired communications medium, a network interface card (NIC), disc controller, video controller, audio controller, and so forth. Examples of wired communications media may include a wire, cable metal leads, printed circuit board (PCB), backplane, switch fabric, semiconductor material, twisted pair wire, coaxial cable, fiber optics, and so forth.

Various embodiments may be implemented using hardware elements, software elements, or a combination of both. Examples of hardware elements may include processors, microprocessors, circuits, circuit elements (for example, transistors, resistors, capacitors, inductors, and so forth), integrated circuits, ASICs, programmable logic devices, digital signal processors, FPGAs, logic gates, registers, semiconductor devices, chips, microchips, chipsets, and so forth. Examples of software may include software components, programs, applications, computer programs, application programs, system programs, machine programs, operating system software, middleware, firmware, software modules, routines, subroutines, functions, methods, procedures, software interfaces, application program interfaces, instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power level, heat tolerances, processing cycle budget, input data rates, output data rates, memory resources, data bus speeds, and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

The various embodiments disclosed herein can be implemented in various forms of hardware, software, firmware, and/or special purpose processors. For example, in one embodiment at least one non-transitory computer readable storage medium has instructions encoded thereon that, when executed by one or more processors, cause one or more of the methodologies disclosed herein to be implemented. The instructions can be encoded using a suitable programming language, such as C, C++, object-oriented C, Java, JavaScript, Visual Basic .NET, Beginner's All-Purpose Symbolic Instruction Code (BASIC), or alternatively, using custom or proprietary instruction sets. The instructions can be provided in the form of one or more computer software applications and/or applets that are tangibly embodied on a memory device, and that can be executed by a computer having any suitable architecture. In one embodiment, the system can be hosted on a given website and implemented, for example, using JavaScript or another suitable browser-based technology. For instance, in certain embodiments, the system may leverage processing resources provided by a remote computer system accessible via network 1594. The computer software applications disclosed herein may include any number of different modules, sub-modules, or other components of distinct functionality, and can provide information to, or receive information from, still other components. These modules can be used, for example, to communicate with input and/or output devices such as a display screen, a touch sensitive surface, a printer, and/or any other suitable device. Other componentry and functionality not reflected in the illustrations will be apparent in light of this disclosure, and it will be appreciated that other embodiments are not limited to any particular hardware or software configuration. Thus, in other embodiments platform 1500 may comprise additional, fewer, or alternative subcomponents as compared to those included in the example embodiment of FIG. 15.

The aforementioned non-transitory computer readable medium may be any suitable medium for storing digital information, such as a hard drive, a server, a flash memory, and/or random-access memory (RAM), or a combination of memories. In alternative embodiments, the components and/or modules disclosed herein can be implemented with hardware, including gate level logic such as a field-programmable gate array (FPGA), or alternatively, a purpose-built semiconductor such as an application-specific integrated circuit (ASIC). Still other embodiments may be implemented with a microcontroller having a number of input/output ports for receiving and outputting data, and a number of embedded routines for carrying out the various functionalities disclosed herein. It will be apparent that any suitable combination of hardware, software, and firmware can be used, and that other embodiments are not limited to any particular system architecture.

Some embodiments may be implemented, for example, using a machine readable medium or article which may store an instruction or a set of instructions that, if executed by a machine, may cause the machine to perform a method, process, and/or operations in accordance with the embodiments. Such a machine may include, for example, any suitable processing platform, computing platform, computing device, processing device, computing system, processing system, computer, process, or the like, and may be implemented using any suitable combination of hardware and/or software. The machine readable medium or article may include, for example, any suitable type of memory unit, memory device, memory article, memory medium, storage device, storage article, storage medium, and/or storage unit, such as memory, removable or non-removable media, erasable or non-erasable media, writeable or rewriteable media, digital or analog media, hard disk, floppy disk, compact disk read only memory (CD-ROM), compact disk recordable (CD-R) memory, compact disk rewriteable (CD-RW) memory, optical disk, magnetic media, magneto-optical media, removable memory cards or disks, various types of digital versatile disk (DVD), a tape, a cassette, or the like. The instructions may include any suitable type of code, such as source code, compiled code, interpreted code, executable code, static code, dynamic code, encrypted code, and the like, implemented using any suitable high level, low level, object oriented, visual, compiled, and/or interpreted programming language.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical entities within the registers, memory units, or other such information storage transmission or displays of the computer system. The embodiments are not limited in this context.

The terms "circuit" or "circuitry," as used in any embodiment herein, are functional and may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smartphones, etc. Other embodiments may be implemented as software executed by a programmable control device. In such cases, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood by an ordinarily skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is at least one non-transitory machine-readable storage medium having instructions encoded thereon that, when executed by one or more processors, cause a process to be carried out for estimation of microphone location within a device, the process comprising: estimating a first impulse response (IR) of a first microphone based on a comparison of a test audio signal received at an angle of incidence through the first microphone to the test audio signal received through a reference microphone; estimating a second IR of a second microphone based on a comparison of the test audio signal received at the angle of incidence through the second microphone to the test audio signal received through the reference microphone; determining a relative delay between the first microphone and the second microphone based on a relationship between the first IR and the second IR; and calculating a distance between the first microphone and a geometric center of the first and second microphones, the distance calculation based on the relative delay.

Example 2 includes the subject matter of Example 1, wherein the relationship is a relationship between a group delay calculated for the first microphone based on a phase response of the first IR, and a group delay calculated for the second microphone based on a phase response of the second IR, and wherein the calculated distance is a distance projected onto a measurement axis associated with the angle of incidence.

Example 3 includes the subject matter of Examples 1 or 2, wherein the estimating of the first IR comprises: performing clock drift compensation of the test audio signal received through the first microphone based on a tone signal of known frequency included in the test audio signal; performing delay compensation of the test audio signal received through the first microphone relative to the test audio signal received through the reference microphone to generate a first audio signal; performing sensitivity compensation of the test audio signal received through the reference microphone to generate a second audio signal; transforming the first audio signal and the second audio signal to the frequency domain; generating a transfer function by dividing the first audio signal in the frequency domain by the second audio signal in the frequency domain; and transforming the transfer function to the time domain as the estimated first IR.

Example 4 includes the subject matter of any of Examples 1-3, wherein the angle of incidence is a first angle of incidence, the distance is a first distance, and the process further comprises repeating the process for a second angle of incidence to generate a second distance and combining the first distance and the second distance for mapping to cartesian coordinates of the first microphone relative to the geometric center.

Example 5 includes the subject matter of any of Examples 1-4, further comprising comparing the mapped cartesian coordinates of the first microphone to expected microphone location coordinates to generate a validation metric for the first microphone.

Example 6 includes the subject matter of any of Examples 1-5, further comprising calculating a directional sensitivity for the first microphone, associated with the angle of incidence, based on application of the first IR to a test signal to generate a filtered test signal, the sensitivity calculated as a difference between a root mean square level of the test signal and a root mean square level of the filtered test signal.

Example 7 is a system for estimation of microphone location within a device, the system comprising: a differential impulse response (IR) analysis circuit to estimate a first IR of a first microphone based on a comparison of a test audio signal received at an angle of incidence through the first microphone to the test audio signal received through a reference microphone; the differential IR analysis circuit further to estimate a second IR of a second microphone based on a comparison of the test audio signal received at the angle of incidence through the second microphone to the test audio signal received through the reference microphone; an average group delay calculation circuit to calculate a relative delay between the first microphone and the second microphone based on a relationship between the first IR and the second IR; and a distance projection circuit to calculate a distance between the first microphone and a geometric center of the first and second microphones, the distance calculation based on the relative delay.

Example 8 includes the subject matter of Example 7, wherein the relationship is a relationship between a group delay calculated for the first microphone based on a phase response of the first IR, and a group delay calculated for the second microphone based on a phase response of the second IR, and wherein the calculated distance is a distance projected onto a measurement axis associated with the angle of incidence.

Example 9 includes the subject matter of Example 7 or 8, further comprising: a clock drift compensation circuit to perform clock drift compensation of the test audio signal received through the first microphone based on a tone signal of known frequency included in the test audio signal; a delay compensation circuit to perform delay compensation of the test audio signal received through the first microphone relative to the test audio signal received through the reference microphone to generate a first audio signal; a reference sensitivity compensation circuit to perform sensitivity compensation of the test audio signal received through the reference microphone to generate a second audio signal; a Fast Fourier Transform (FFT) circuit to transform the first audio signal and the second audio signal to the frequency domain; a transfer function computation circuit to generate a transfer function by dividing the first audio signal in the frequency domain by the second audio signal in the frequency domain; and an inverse FFT circuit to transform the transfer function to the time domain as the estimated first IR.

Example 10 includes the subject matter of any of Examples 7-9, wherein the angle of incidence is a first angle of incidence, the distance is a first distance, and the process further comprises repeating the process for a second angle of incidence to generate a second distance and combining the first distance and the second distance for mapping to cartesian coordinates of the first microphone relative to the geometric center.

Example 11 includes the subject matter of any of Examples 7-10, further comprising a comparison circuit to compare the mapped cartesian coordinates of the first microphone to expected microphone location coordinates to generate a validation metric for the first microphone.

Example 12 includes the subject matter of any of Examples 7-11, wherein the first and second microphones are incorporated in a device under test (DUT), the system further comprising a rotating fixture to rotate the DUT from the first angle of incidence to the second angle of incidence.

Example 13 includes the subject matter of any of Examples 7-12, further comprising a directional sensitivity calculation circuit to calculate a directional sensitivity for the first microphone, associated with the angle of incidence, based on application of the first IR to a test signal to generate a filtered test signal, the sensitivity calculated as a difference between a root mean square level of the test signal and a root mean square level of the filtered test signal.

Example 14 is a method for estimation of microphone location within a device, the method comprising: estimating, by a processor-based system, a first impulse response (IR) of a first microphone based on a comparison of a test audio signal received at an angle of incidence through the first microphone to the test audio signal received through a reference microphone; estimating, by the processor-based system, a second IR of a second microphone based on a comparison of the test audio signal received at the angle of incidence through the second microphone to the test audio signal received through the reference microphone; determining, by the processor-based system, a relative delay between the first microphone and the second microphone based on a relationship between the first IR and the second IR; and calculating, by the processor-based system, a distance between the first microphone and a geometric center of the first and second microphones, the distance calculation based on the relative delay.

Example 15 includes the subject matter of Example 14, wherein the relationship is a relationship between a group delay calculated for the first microphone based on a phase response of the first IR, and a group delay calculated for the second microphone based on a phase response of the second IR, and wherein the calculated distance is a distance projected onto a measurement axis associated with the angle of incidence.

Example 16 includes the subject matter of Examples 14 or 15, wherein the estimating of the first IR comprises: performing clock drift compensation of the test audio signal received through the first microphone based on a tone signal of known frequency included in the test audio signal; performing delay compensation of the test audio signal received through the first microphone relative to the test audio signal received through the reference microphone to generate a first audio signal; performing sensitivity compensation of the test audio signal received through the reference microphone to generate a second audio signal; transforming the first audio signal and the second audio signal to the frequency domain; generating a transfer function by dividing the first audio signal in the frequency domain by the second audio signal in the frequency domain; and transforming the transfer function to the time domain as the estimated first IR.

Example 17 includes the subject matter of any of Examples 14-16, wherein the angle of incidence is a first angle of incidence, the distance is a first distance, and the process further comprises repeating the process for a second angle of incidence to generate a second distance and combining the first distance and the second distance for mapping to cartesian coordinates of the first microphone relative to the geometric center.

Example 18 includes the subject matter of any of Examples 14-17, further comprising comparing the mapped cartesian coordinates of the first microphone to expected microphone location coordinates to generate a validation metric for the first microphone.

Example 19 includes the subject matter of any of Examples 14-18, wherein the first and second microphones are incorporated in a device under test (DUT), the method further comprising rotating the DUT from the first angle of incidence to the second angle of incidence, and calculating directional sensitivities for the first microphone, associated with the first angle of incidence and the second angle of incidence, based on application of the first IR to a test signal to generate a filtered test signal, the sensitivities calculated as a difference between a root mean square level of the test signal and a root mean square level of the filtered test signal.

Example 20 includes the subject matter of any of Examples 14-19, further comprising calculating directional sensitivities for the second microphone, associated with the first angle of incidence and the second angle of incidence, and comparing the directional sensitivities of the first microphone to the directional sensitivities of the second microphone to determine inter-channel sensitivity coherence as a validation metric for the first microphone and the second microphone.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. It is intended that the scope of the present disclosure be limited not by this detailed description, but rather by the claims appended hereto. Future filed applications claiming priority to this application may claim the disclosed subject matter in a different manner and may generally include any set of one or more elements as variously disclosed or otherwise demonstrated herein.

What is claimed is:

1. At least one non-transitory computer readable storage medium having instructions encoded thereon that, when executed by one or more processors, cause a process to be carried out for estimation of microphone location within a device, the process comprising:

estimating a first impulse response (IR) of a first microphone based on a comparison of a test audio signal received at an angle of incidence through the first microphone to the test audio signal received through a reference microphone;

estimating a second IR of a second microphone based on a comparison of the test audio signal received at the angle of incidence through the second microphone to the test audio signal received through the reference microphone;

determining a relative delay between the first microphone and the second microphone based on a relationship between the first IR and the second IR; and calculating a distance between the first microphone and a geometric center of the first and second microphones, the distance calculation based on the relative delay.

2. The at least one non-transitory computer readable storage medium of claim 1, wherein the relationship is a relationship between a group delay calculated for the first microphone based on a phase response of the first IR, and a group delay calculated for the second microphone based on a phase response of the second IR, and wherein the calculated distance is a distance projected onto a measurement axis associated with the angle of incidence.

3. The at least one non-transitory computer readable storage medium of claim 1, wherein the estimating of the first IR includes:

performing clock drift compensation of the test audio signal received through the first microphone based on a tone signal of known frequency included in the test audio signal;

performing delay compensation of the test audio signal received through the first microphone relative to the test audio signal received through the reference microphone to generate a first audio signal;

performing sensitivity compensation of the test audio signal received through the reference microphone to generate a second audio signal;

transforming the first audio signal and the second audio signal to a frequency domain;

generating a transfer function by dividing the first audio signal in the frequency domain by the second audio signal in the frequency domain; and transforming the transfer function to a time domain as the estimated first IR.

4. The at least one non-transitory computer readable storage medium of claim 1, wherein the angle of incidence is a first angle of incidence, the distance is a first distance, and the process further includes repeating the process for a second angle of incidence to generate a second distance and combining the first distance and the second distance for mapping to cartesian coordinates of the first microphone relative to the geometric center.

5. The at least one non-transitory computer readable storage medium of claim 4, wherein the process further includes comparing the mapped cartesian coordinates of the first microphone to expected microphone location coordinates to generate a validation metric for the first microphone.

6. The at least one non-transitory computer readable storage medium of claim 1, wherein the process further includes calculating a directional sensitivity for the first microphone, associated with the angle of incidence, based on application of the first IR to a test signal to generate a filtered test signal, the sensitivity calculated as a difference between a root mean square level of the test signal and a root mean square level of the filtered test signal.

7. A system for estimation of microphone location within a device, the system comprising:

a differential impulse response (IR) analysis circuit to estimate a first IR of a first microphone based on a comparison of a test audio signal received at an angle of incidence through the first microphone to the test audio signal received through a reference microphone;

the differential IR analysis circuit further to estimate a second IR of a second microphone based on a comparison of the test audio signal received at the angle of incidence through the second microphone to the test audio signal received through the reference microphone;

an average group delay calculation circuit to calculate a relative delay between the first microphone and the second microphone based on a relationship between the first IR and the second IR; and a distance projection circuit to calculate a distance between the first microphone and a geometric center of the first and second microphones, the distance calculation based on the relative delay.

8. The system of claim 7, wherein the relationship is a relationship between a group delay calculated for the first microphone based on a phase response of the first IR, and a group delay calculated for the second microphone based on a phase response of the second IR, and wherein the calculated distance is a distance projected onto a measurement axis associated with the angle of incidence.

9. The system of claim 7, further including:

a clock drift compensation circuit to perform clock drift compensation of the test audio signal received through the first microphone based on a tone signal of known frequency included in the test audio signal;

a delay compensation circuit to perform delay compensation of the test audio signal received through the first microphone relative to the test audio signal received through the reference microphone to generate a first audio signal;

a reference sensitivity compensation circuit to perform sensitivity compensation of the test audio signal received through the reference microphone to generate a second audio signal;

a Fast Fourier Transform (FFT) circuit to transform the first audio signal and the second audio signal to a frequency domain;

a transfer function computation circuit to generate a transfer function by dividing the first audio signal in the frequency domain by the second audio signal in the frequency domain; and an inverse FFT circuit to transform the transfer function to a time domain as the estimated first IR.

10. The system of claim 7, wherein the angle of incidence is a first angle of incidence, the distance is a first distance, and the differential IR analysis circuit, the average group delay calculation circuit and the distance projection circuit are to repeat processing for a second angle of incidence to generate a second distance, and further including a coordinate mapping circuit to combine the first distance and the second distance for mapping to cartesian coordinates of the first microphone relative to the geometric center.

11. The system of claim 10, further including a comparison circuit to compare the mapped cartesian coordinates of the first microphone to expected microphone location coordinates to generate a validation metric for the first microphone.

12. The system of claim 10, wherein the first and second microphones are incorporated in a device under test (DUT), the system further including a rotating fixture to rotate the DUT from the first angle of incidence to the second angle of incidence.

13. The system of claim 7, further including a directional sensitivity calculation circuit to calculate a directional sensitivity for the first microphone, associated with the angle of incidence, based on application of the first IR to a test signal to generate a filtered test signal, the sensitivity calculated as a difference between a root mean square level of the test signal and a root mean square level of the filtered test signal.

14. A method for estimation of microphone location within a device, the method comprising:

estimating, by a processor-based system, a first impulse response (IR) of a first microphone based on a comparison of a test audio signal received at an angle of incidence through the first microphone to the test audio signal received through a reference microphone;

estimating, by the processor-based system, a second IR of a second microphone based on a comparison of the test audio signal received at the angle of incidence through the second microphone to the test audio signal received through the reference microphone;

determining, by the processor-based system, a relative delay between the first microphone and the second microphone based on a relationship between the first IR and the second IR; and calculating, by the processor-based system, a distance between the first microphone and a geometric center of the first and second microphones, the distance calculation based on the relative delay.

15. The method of claim 14, wherein the relationship is a relationship between a group delay calculated for the first microphone based on a phase response of the first IR, and a group delay calculated for the second microphone based on a phase response of the second IR, and wherein the calculated distance is a distance projected onto a measurement axis associated with the angle of incidence.

16. The method of claim 14, wherein the estimating of the first IR includes:

performing clock drift compensation of the test audio signal received through the first microphone based on a tone signal of known frequency included in the test audio signal;

performing delay compensation of the test audio signal received through the first microphone relative to the test audio signal received through the reference microphone to generate a first audio signal;

performing sensitivity compensation of the test audio signal received through the reference microphone to generate a second audio signal;

transforming the first audio signal and the second audio signal to a frequency domain;

generating a transfer function by dividing the first audio signal in the frequency domain by the second audio signal in the frequency domain; and transforming the transfer function to a time domain as the estimated first IR.

17. The method of claim 14, wherein the angle of incidence is a first angle of incidence, the distance is a first distance, and further including repeating processing for a second angle of incidence to generate a second distance and combining the first distance and the second distance for mapping to cartesian coordinates of the first microphone relative to the geometric center.

18. The method of claim 17, further including comparing the mapped cartesian coordinates of the first microphone to expected microphone location coordinates to generate a validation metric for the first microphone.

19. The method of claim 17, wherein the first and second microphones are incorporated in a device under test (DUT), the method further including rotating the DUT from the first angle of incidence to the second angle of incidence, and calculating directional sensitivities for the first microphone, associated with the first angle of incidence and the second angle of incidence, based on application of the first IR to a test signal to generate a filtered test signal, the sensitivities calculated as a difference between a root mean square level of the test signal and a root mean square level of the filtered test signal.

20. The method of claim 19, further including calculating directional sensitivities for the second microphone, associated with the first angle of incidence and the second angle of incidence, and comparing the directional sensitivities of the first microphone to the directional sensitivities of the second microphone to determine inter-channel sensitivity coherence as a validation metric for the first microphone and the second microphone.

* * * * *